US005411106A

United States Patent [19]

Maissa et al.

[11] Patent Number: 5,411,106

[45] Date of Patent: May 2, 1995

[54] METHOD AND APPARATUS FOR ACQUIRING AND IDENTIFYING MULTIPLE SIDEWALL CORE SAMPLES

[75] Inventors: Jacques Maissa; Marcelo F. Civarolo; Derryl G. Schroeder, all of Houston, Tex.

[73] Assignee: Western Atlas International, Inc., Houston, Tex.

[21] Appl. No.: 146,441

[22] Filed: Oct. 29, 1993

[51] Int. Cl.[6] ..... E21B 25/02

[52] U.S. Cl. ..... 175/78; 175/250; 175/254

[58] Field of Search ..... 175/58, 78, 249, 250, 175/251, 252, 253, 254

[56] References Cited

U.S. PATENT DOCUMENTS 2,181,980 12/1939 Seale ..... 175/254 X
4,396,074 8/1983 Sageler et al. ..... 175/78

FOREIGN PATENT DOCUMENTS 48506 6/1985 U.S.S.R. ..... 175/254

*Primary Examiner*—William P. Neuder
*Attorney, Agent, or Firm*—Darryl M. Springs

[57] ABSTRACT

A method and apparatus for acquiring a plurality of sidewall cores from an earth formation intersected by a wellbore while a coring tool is located downhole. A sidewall coring tool is provided having an internal core receptacle for receiving and storing sidewall cores in serial orientation. The coring tool incorporates a movable bit box providing rotary support and linear coring and retracting movement of a rotary coring bit. A bit box tilting and rotation actuator is incorporated within the coring tool for achieving breaking at the core sample from the formation and for selectively positioning of the bit box and rotary coring bit at a coring position where the bit is oriented in normal relation with the axis of the wellbore and a core ejecting position where the rotary coring bit is positioned in registry with the internal core receptacle for deposit of cores in serially oriented relation therein. Another actuator is provided for accomplishing lateral coring and retracting movement of the rotary coring bit for acquiring a core and for retracting the bit and core within the coring tool. A third actuator is provided within the coring tool for displacing cores from the rotary coring bit into the core receptacle after the rotary coring bit has been positioned in registry with the core receptacle. A mechanism is also provided for locking the coring bit against inadvertent extension during bit box rotation. The sidewall coring mechanism further incorporates a reduction gear transmission permitting slow speed, high torque rotation of the coring bit, which transmission is automatically disengaged when the bit box is rotated from the coring position.

17 Claims, 16 Drawing Sheets

METHOD AND APPARATUS FOR ACQUIRING AND IDENTIFYING MULTIPLE SIDEWALL CORE SAMPLES

BACKGROUND OF THE INVENTION

Field of the Invention

This invention relates generally to wireline apparatus for sidewall coring in well bores drilled for production of petroleum products. More particularly, the present invention relates to rotary sidewall coring apparatus for acquiring multiple sidewall cores while operating in the downhole environment and for depositing the cores within a core receiving receptacle in such manner that individual cores may be separately classified so as to be related to formation depth when subsequent analysis is performed.

Discussion of Related Art

It is common geophysical practice to collect cores from oil and gas bore holes at known depth for analyzing the core materials in order to determine various characteristics of the subterranean earth formation.

Various sidewall coring apparatus has been developed and utilized for obtaining sidewall cores at selected depths. For the most part, however, these previous sidewall coring tools have the problem of easily stalling during coring activity because the coring bit thereof is typically operated by small high speed direct drive motors having only low torque capability. These types of coring tools typically have limitations that present a significant need which is effectively satisfied by the present invention.

SUMMARY OF THE INVENTION

It is a principle feature of the present invention to provide a novel sidewall coring tool which incorporates a coring box assembly which is selectively positionable in a coring position for generally normal orientation of a rotary coring bit with respect to the axis of the borehole and which is positioned in rotatable and linearly movable relation for coring into the sidewall of the wellbore and positionable in a core ejection position where cores taken from the formation can be ejected from the rotary coring bit and into a core containing receptacle.

It is another feature of this invention to provide a sidewall coring tool mechanism having a drive motor and a rotary coring bit which are selectively interconnected in driving relation by a geared transmission which causes the drive motor to be engaged in rotheary driving relation with the rotary coring bit at the coring position thereof and disengaged from driving relation with the rotary coring bit at the core ejecting position of the bit.

It is also a feature of this invention to provide a novel sidewall coring mechanism incorporating an automatic drilling feature which maximizes drilling capability and minimizes sticking of the bit while drilling.

It is an even further feature of this invention to provide a novel sidewall coring tool having a rotary coring bit that provides for high torque, slow speed rotation of the rotary coring bit thereof to minimize heat generation during coring operations and to promote extensive service life thereof.

It is also a feature of this invention to provide a novel sidewall coring tool incorporating a bit box assembly which is subject to compound rotational movement between its coring and core ejecting positions and which is tilted for breaking the core from the formation and which includes a bit box rotation actuation mechanism having an actuator arm pivot connection with the bit box which defines locked and unlocked positions relative thereto.

It is also a novel feature of this invention to provide a method and apparatus for efficient recovery of multiple core samples from the sidewall formation of well bores.

It is another feature of the present invention to provide a novel sidewall coring tool incorporating an internal bit closure element which is moved between open and closed positions relative to a bit opening in the housing in response to compound rotational movement of the bit box assembly of the tool.

It is also a feature of this invention to provide a novel sidewall coring mechanism having a coring bit provided with a core retainer that permits linear retraction of the rotary bit while rotating or without rotation while the core remains connected to the formation, to thus permit the clearing of any debris build-up behind the bit which might cause it to stick in the sidewall formation.

It is another feature of the present invention to provide a novel sidewall coring mechanism providing well service personnel with the capability of controlling individual coring tool functions such as bit rotation, bit box positioning, bit box tilt for core breaking, core ejection from the coring bit as well as coring bit extension and retraction.

It is another feature of this invention to provide a novel sidewall coring mechanism which permits continuous monitoring of coring tool operation by operating personnel at the surface.

Briefly, in accordance with a primary principle of the present invention, a sidewall coring tool for wireline use in an earth bore hole is provided which includes an elongate tool body adapted for movement within the borehole by a wireline cable or by any other tool conveyance means for positioning thereof at various selected well depths and locations and which defines therein a receptacle capable of receiving and storing multiple cores in such manner that the cores are subsequently identifiable in conjunction with the formation depth from which they were taken. The sidewall coring tool includes a decentralizing system incorporating two or more decentralizing arms which are mounted in the tool body on the opposite side of the body from which the rotary coring bit is advanced and which are pivotally movable to engage the wail of the bore hole and permit forcible positioning of the rotary coring bit side of the tool against the wail surface of the bore hole. This feature locates the coring tool in substantially immovable relation within the bore hole during the coring operation and permits maximum penetration of the rotary coring bit into the formation wail as each core sample is being acquired.

To enable the acquisition of multiple sidewall cores, the sidewall coring tool includes an internal bit box structure which is positionable at a coring position being oriented such that the rotary coring bit therein is located in substantially normal relation with the axis of the bore hole and a core ejection position at which the rotary coring bit is positioned in substantial registry with the core receptacle of the coring tool body with its axis of rotation coincident with or parallel to the axis of the well bore. The bit box assembly is movable within the tool body in such a manner that it disengages a reduction gear transmission that drives the rotary coring bit and is rotated substantially 90° by a compound rotational movement from the coring position to the core ejecting position. For controlling such compound rotational movement, a pair of linearly movable actuator plates are provided having cam slots which are tracked by orientation guide pins of the bit box during hydraulically energized downward and rotational movement of the bit box assembly while the actuator plates are held stationery at a bit box rotating position. A pair of bit box actuator mechanisms including a pair of actuator arms are provided for cooperatively applying downward force on the bit box assembly to induce its compound rotational movement. When the bit box assembly is secured at an immobilized position against internal positioning stops of the housing by upward force of the actuator arms the actuator plates are moved linearly to achieve linear bit movement for coring activity. For linear coring movement of the rotary coring bit and for linear core retraction movement the cam slots of the actuator plates include inclined substantially straight cam slot sections which are traversed by guide pins of a linearly movable bit block assembly within the bit box housing while the bit box housing is held stationary against internal positioning stops by the bit box actuators while the actuator plates are moved linearly by the plate actuator mechanism. For ejection of the cores from the rotary coring bit, the bit is oriented in registry with the core receptacle after which a core ejection plunger contained within the tool is moved through the central passage of the rotary coring bit to displace the core from the bit and into the core receptacle. The core receptacle is arranged in a manner permitting serial orientation of the cores so that the cores may be individually correlated with the well bore depth or location from which each core was taken.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of t invention and are therefore not to be considered limiting of its scope, for the invention may admit to other equally effective embodiments.

In the drawings:

FIG. 1 is a schematic illustration showing the sidewall coring tool of the present invention being positioned within a bore hole by wireline apparatus;

FIG. 2 is a schematic illustration similar to that of FIG. 1 and showing decentralization of the coring tool by means of decentralizing arms in readiness for a sidewall coring operation;

FIG. 3 is a partial isometric illustration of the internal sidewall coring mechanism of the coring tool of FIGS. 1 and 2 showing the bit box assembly in its coring position and showing a sidewall core being acquired by the rotary coring bit of the coring tool;

FIG. 4 is a partial isometric illustration of the internal sidewall coring mechanism similar to that of FIG. 3, showing the bit box assembly at its core ejection position and illustrating positioning of the sidewall coring mechanism for ejection of the core downwardly into a core magazine;

FIG. 5 is a partial side elevational view of the sidewall coring mechanism being shown at the core ejection position of FIG. 4;

FIG. 6 is a partial elevational illustration of the sidewall coring mechanism illustrating the pivotal bit box assembly at an intermediate position between the coring and core ejection positions thereof;

FIG. 7 is a partial elevational view similar to that of FIGS. 5 and 6, illustrating the pivotal bit box assembly at its coring position and with the coring bit in its fully retracted position;

FIG. 8 is an isometric illustration of the bit box assembly of the multiple sidewall coring tool, with the coring bit thereof being shown in the fully retracted position thereof;

FIG. 9 is an isometric illustration similar to that of FIG. 8, illustrating the bit box assembly in its coring position and showing the rotary coring bit in its fully extended position as it would appear upon completion of a sidewall coring operation;

FIG. 10 is a partial isometric illustration of the bit box assembly showing an upper portion of the bit box assembly with the elongate pinion gear and one of the actuator arms removed for visualization of mechanical components that would otherwise be hidden and showing the actuator arm in its coring bit locking position;

FIG. 11 is a partial isometric illustration similar to that of FIG. 10 and showing the actuator arm assembly in its extended position for immobilizing the bit box housing of the bit box assembly against internal positioning stops to permit coring;

Figure 12:
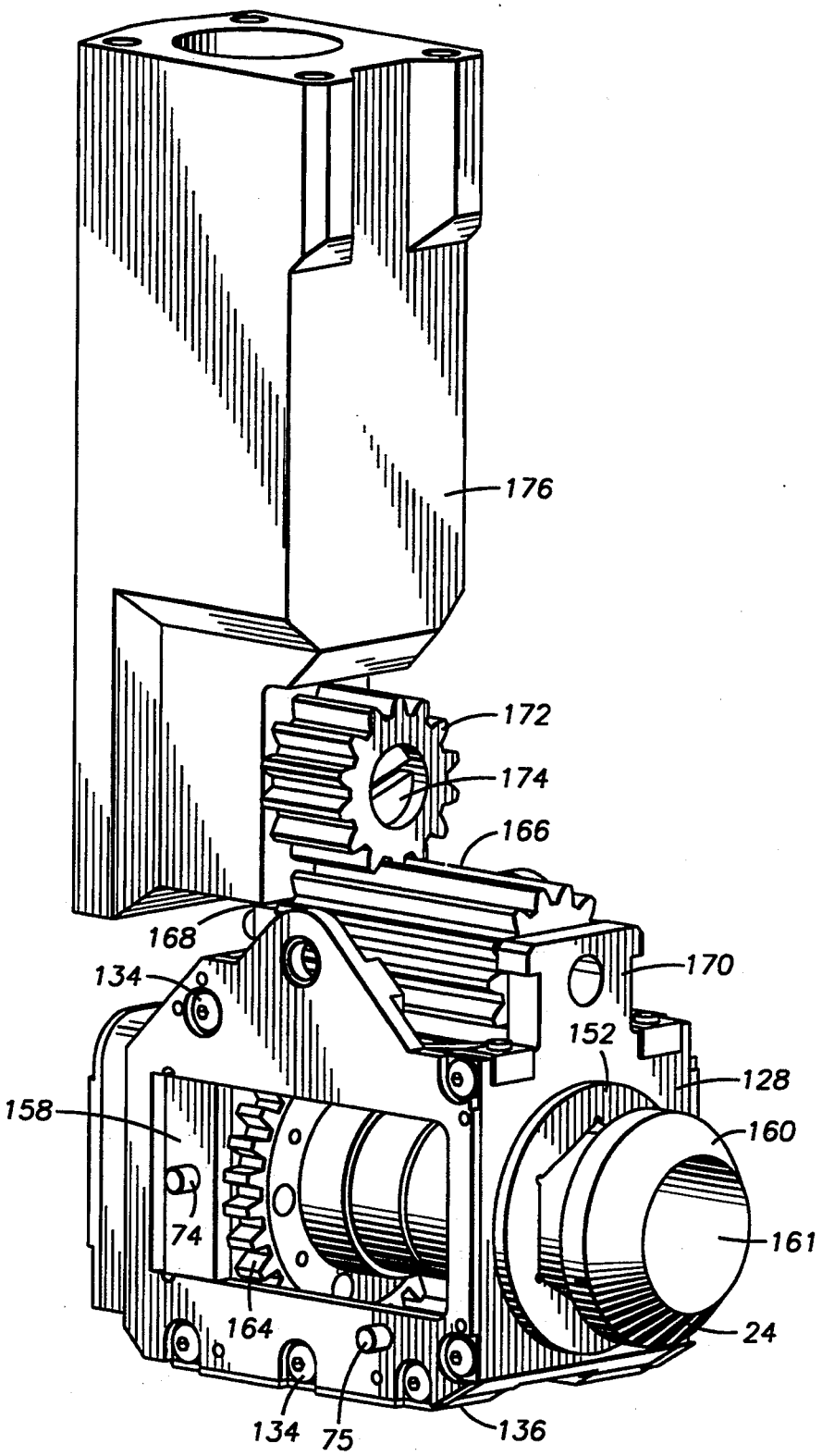
Figure 13:
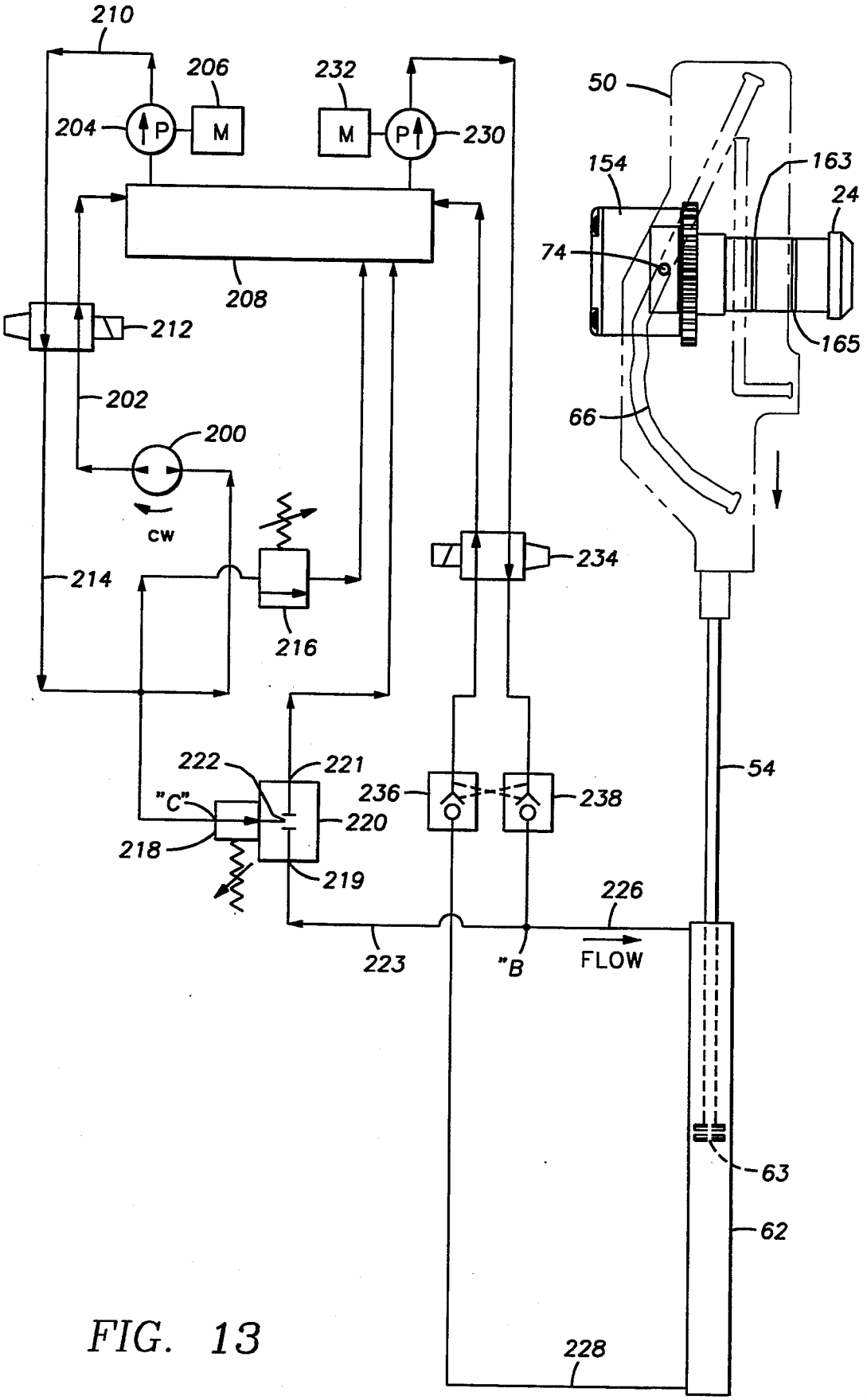
Figure 14:
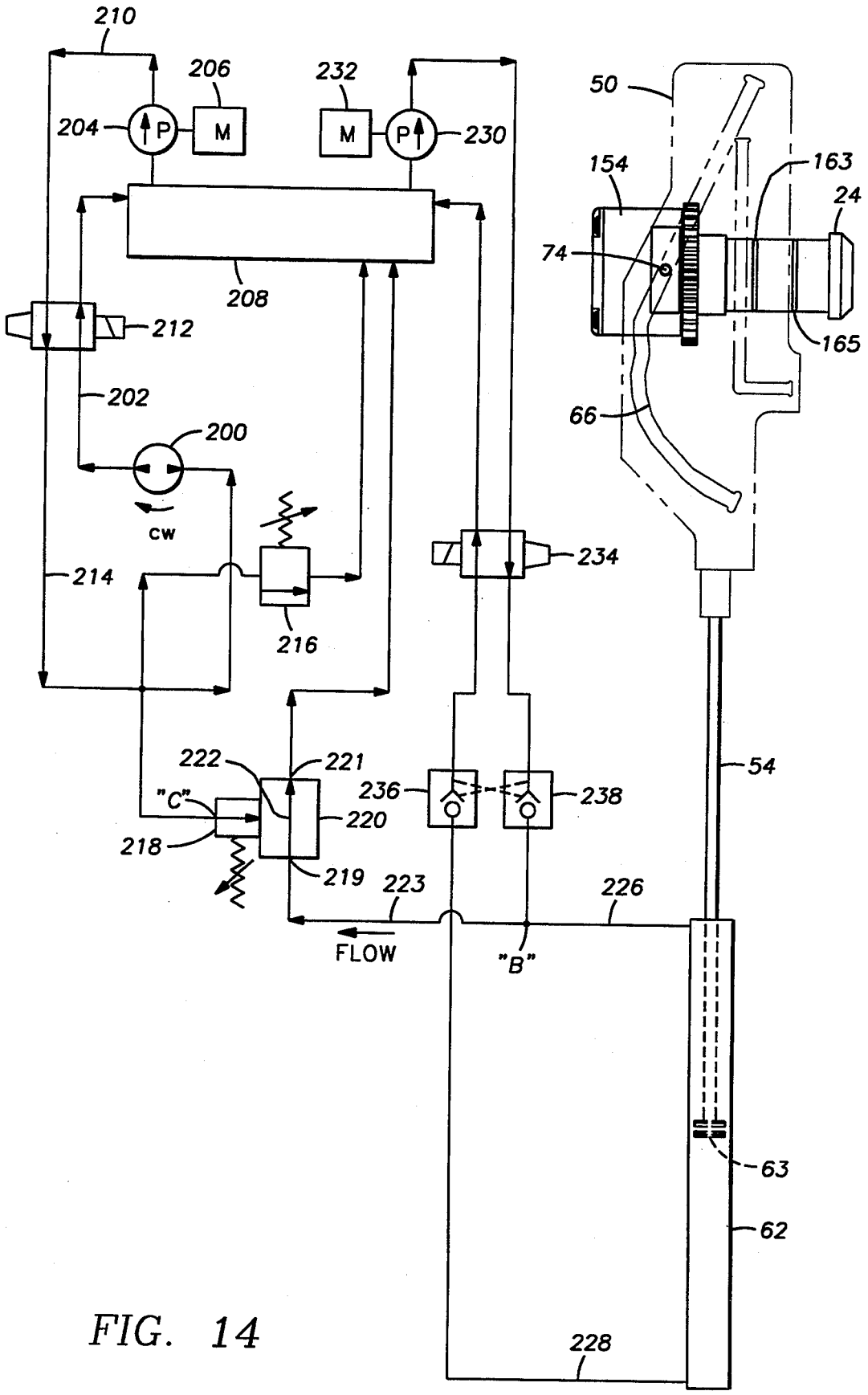
Figure 15:
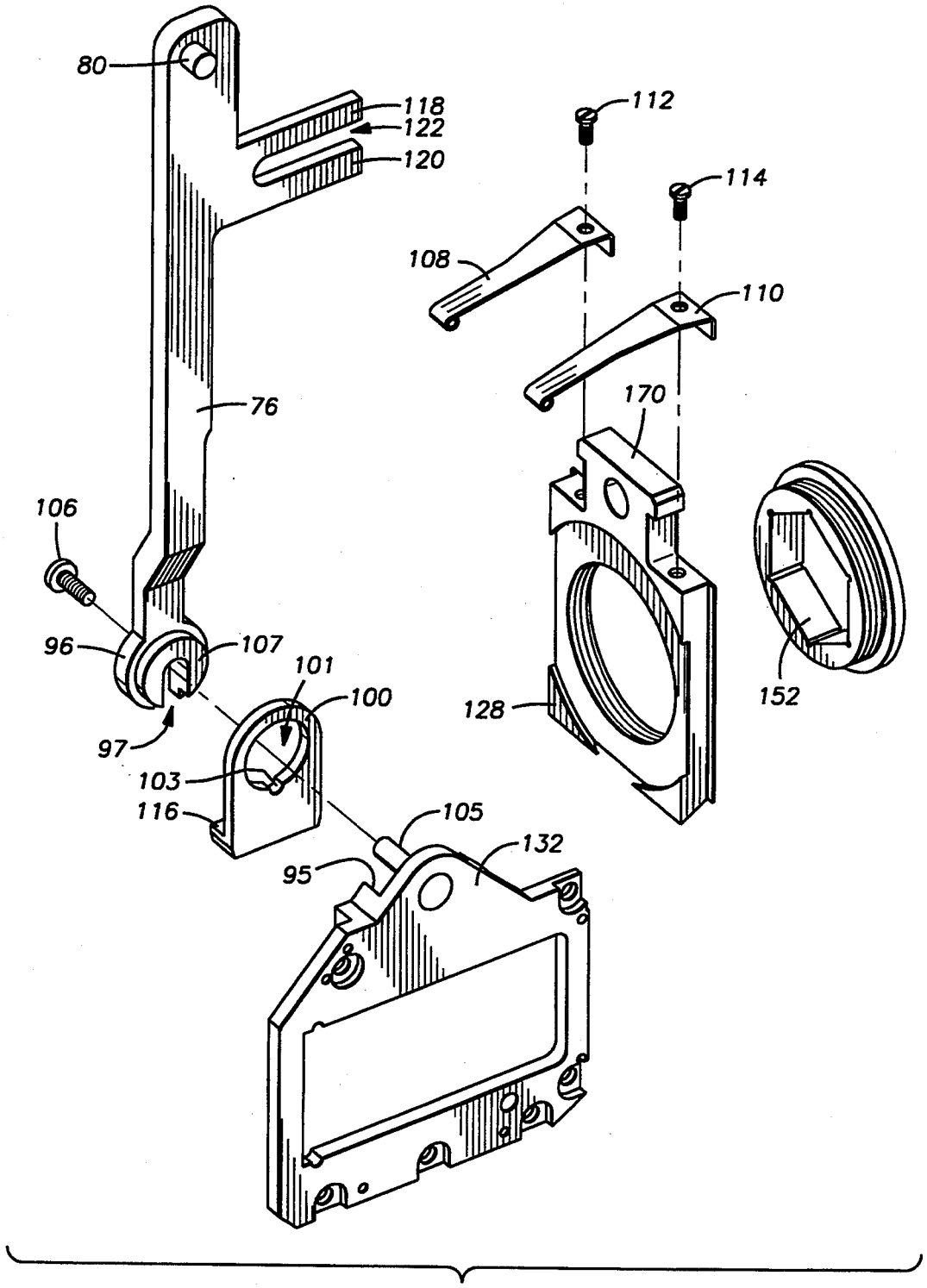
Figure 16:
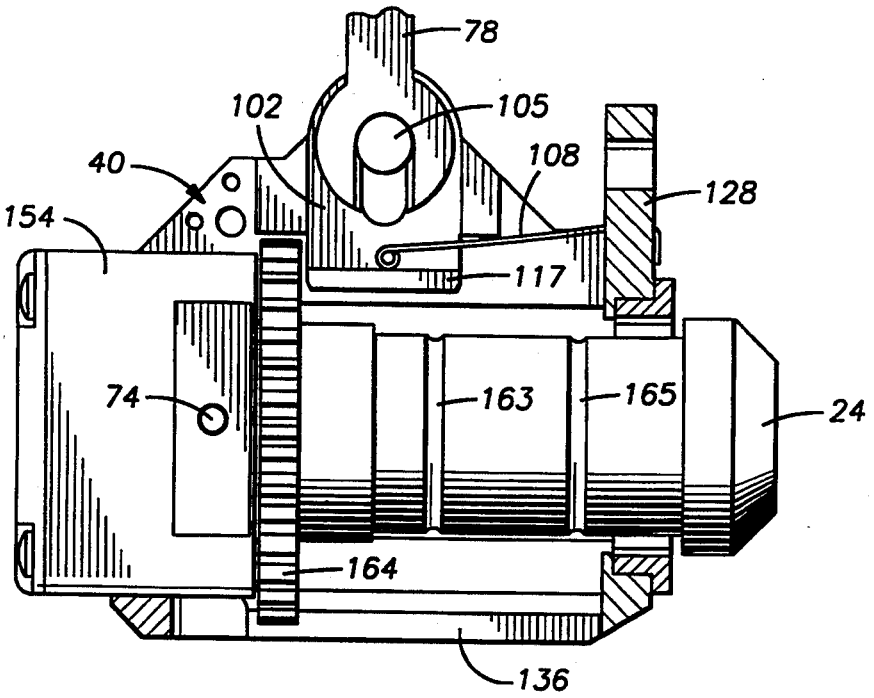
Figure 17:
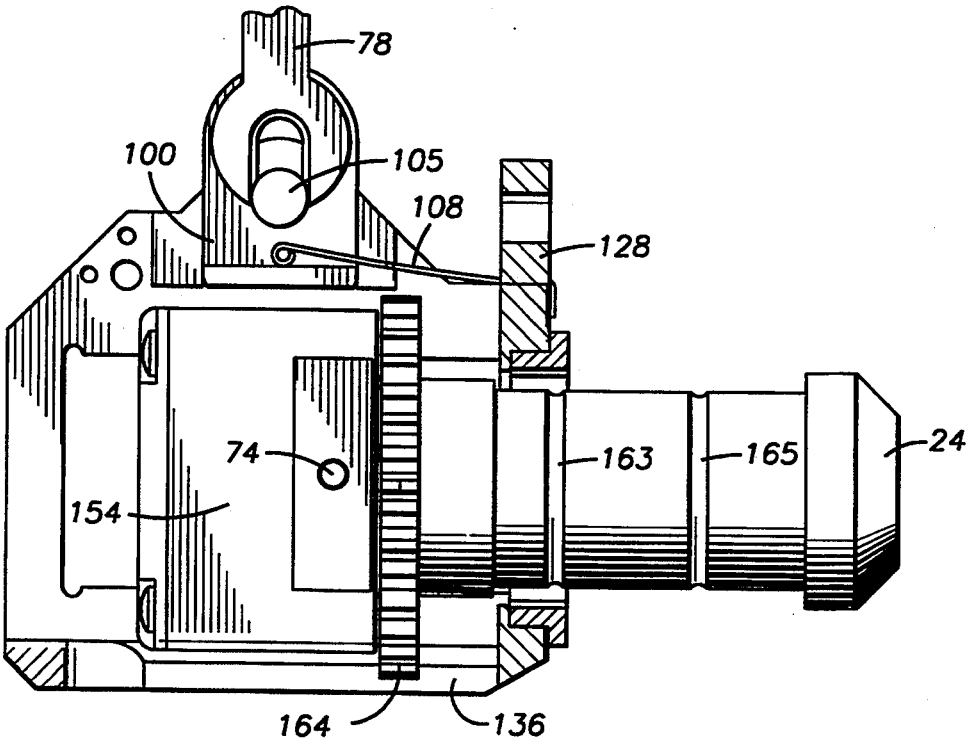

FIG. 12 is an isometric illustration of the bit box assembly and drive motor with the coring bit being shown in its fully retracted position and with the geared transmission between the drive motor and the rotary coring bit being shown engaged in bit driving assembly;

FIG. 13 is a schematic illustration of an automatic, force responsive, drilling control mechanism for the rotary coring bit of t invention and illustrating the normal or drilling mode of the rotary coring bit;

FIG. 14 is a schematic illustration similar to that of FIG. 13 and showing the by-pass mode of the automatic, force responsive sidewall coring mechanism;

FIG. 15 is an exploded isometric illustration of a portion of the bit box and bit box actuator mechanism of FIGS. 8–12 and which shows the locking pivot mechanism of one of the actuator arms in detail;

FIG. 16 is a partial sectional view of the bit box assembly of FIGS. 8–12 showing the components at the unlocked positions thereof permitting pivoting of the bit box relative to the actuator arms and further showing locking of the rotary coring bit against inadvertent linear movement; and FIG. 17 is a partial sectional view of the bit box assembly, similar to that of FIG. 16, and showing the components in the locked positions thereof for preventing pivoting of the bit box relative to the actuator arms and further showing unlocking of the rotary coring bit to permit linear movement thereof relative to the bit box during coring activity.

DETAILED DESCRIPTION OF THE PREFERRED EMBODIMENT

Figure 1:
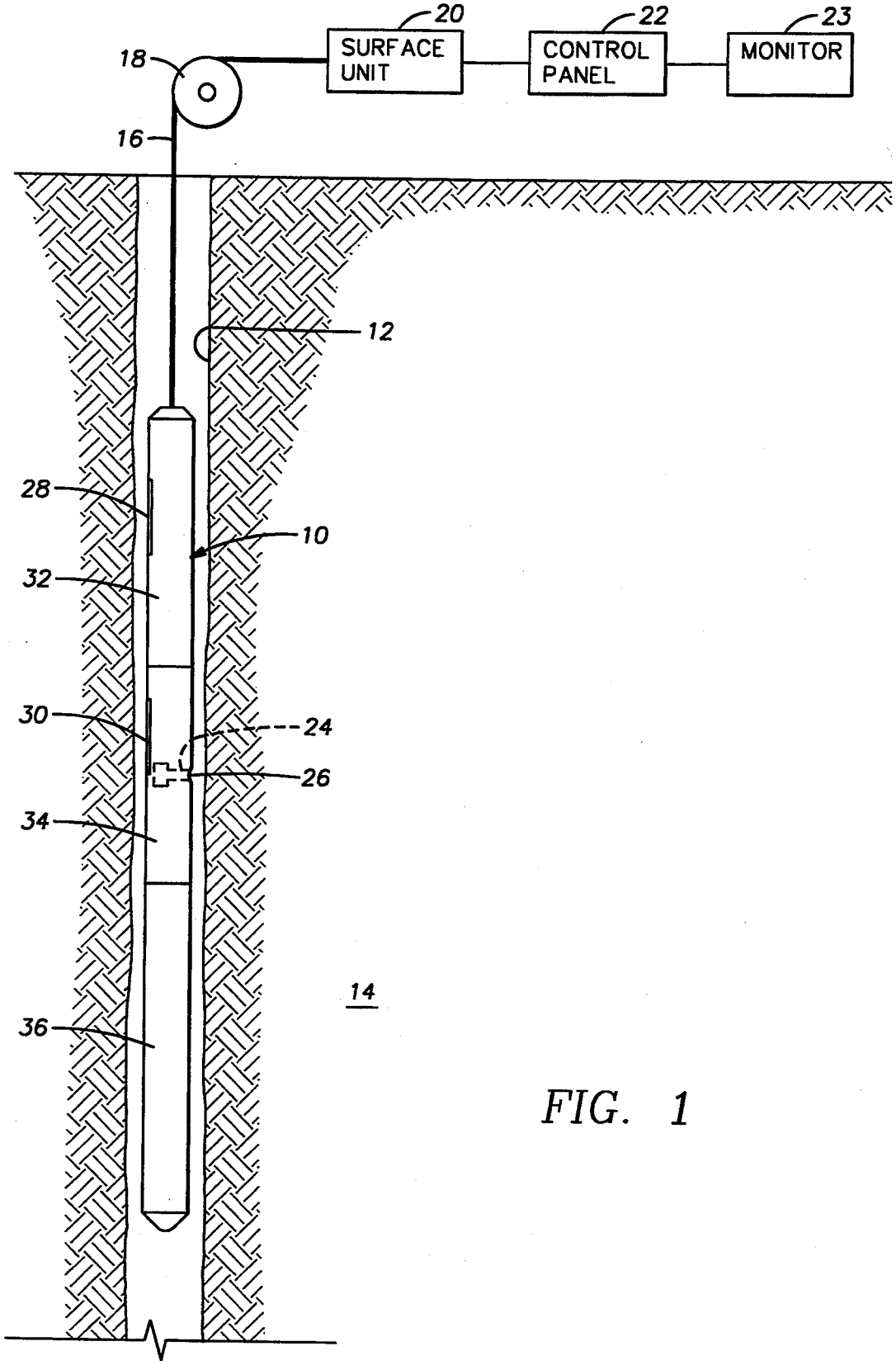
Figure 2:
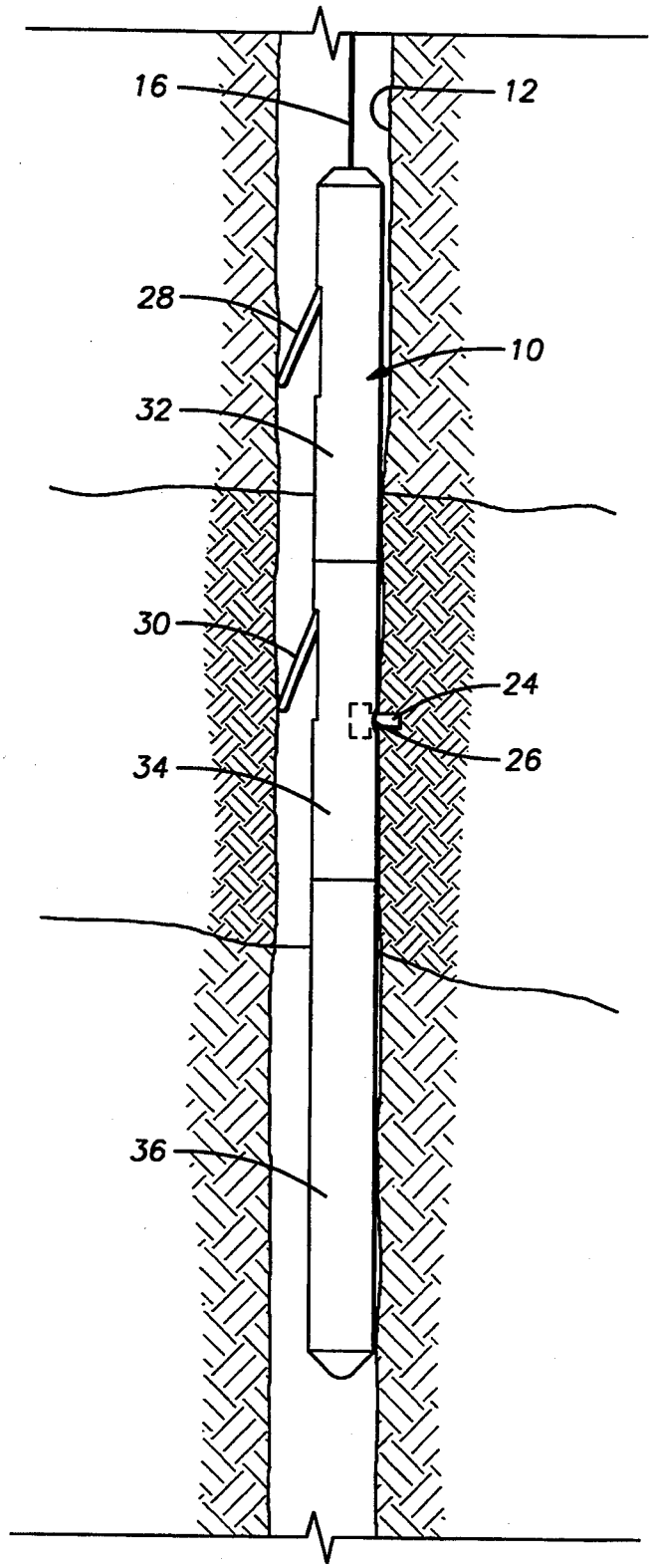

Referring now to FIG. 1 a schematic illustration of the rotary sidewall coring tool of the present invention is illustrated generally at 10 as being positioned within a well bore 12 that is drilled into an earth formation 14. In FIGS. 1 and 2 the sidewall coring tool 10 is shown to be positioned within the well bore by means of a wireline 16 extending over a sheave 18 by a standard winch or hoist apparatus (not shown) which is a component part of a surface unit 20. It should be born in mind that the sidewall coring tool, especially in the case of deviated or horizontal well bores, may be positioned by coil tubing strings, by drill strings or by any other means of tool conveyance without departing from the spirit and scope of t invention. Electrical and hydraulic control of the sidewall coring tool is accomplished by selective manipulation of control elements of a control panel 22 by operating personnel. The coring tool includes a rotary and linearly movable sidewall coring bit 24 which is shown in FIG. 1 at a retracted position within the tool housing in relation to a bit opening 26 in the tool housing of the sidewall coring tool. In FIG. 2 is shown upper and lower decentralizing locking arm pairs 28 and 30 respectively which are located on the side of the tool generally opposite to the coring bit 24. The decentralizing arms are shown in the collapsed positions thereof in FIG. 1 and are shown extended in FIG. 2 for urging the coring tool into firm engagement with the bore hole wall so that the coring bit may be extended fully into the formation during coring.

The coring tool 10 comprises three major sections, being an electrical and electrohydraulic section 32 in which the subsurface electrical components and circuits are located and within which certain apparatus for electrohydraulic actuation of the decentralizing arms and rotary coring bit assembly are located. The tool incorporates an intermediate coring section 34 which defines the opening 26 for the rotary coring bit 24 and which contains apparatus for selectively positioning and actuating the rotary coring bit for coring and core ejection. The coring tool 10 also incorporates a core receptacle section 36 which contains a core receiving tube within which the cores are deposited in serially oriented relation so that the formation depth from which they were taken can be determined at the time of analysis.

Figure 3:
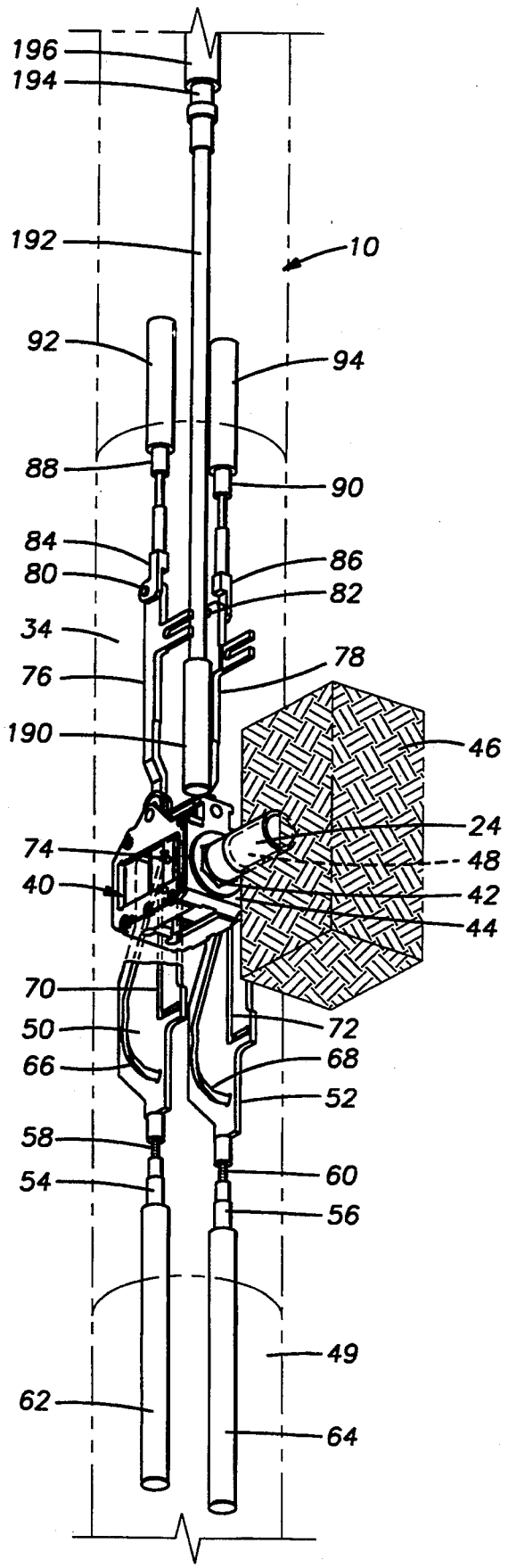
Figure 4:
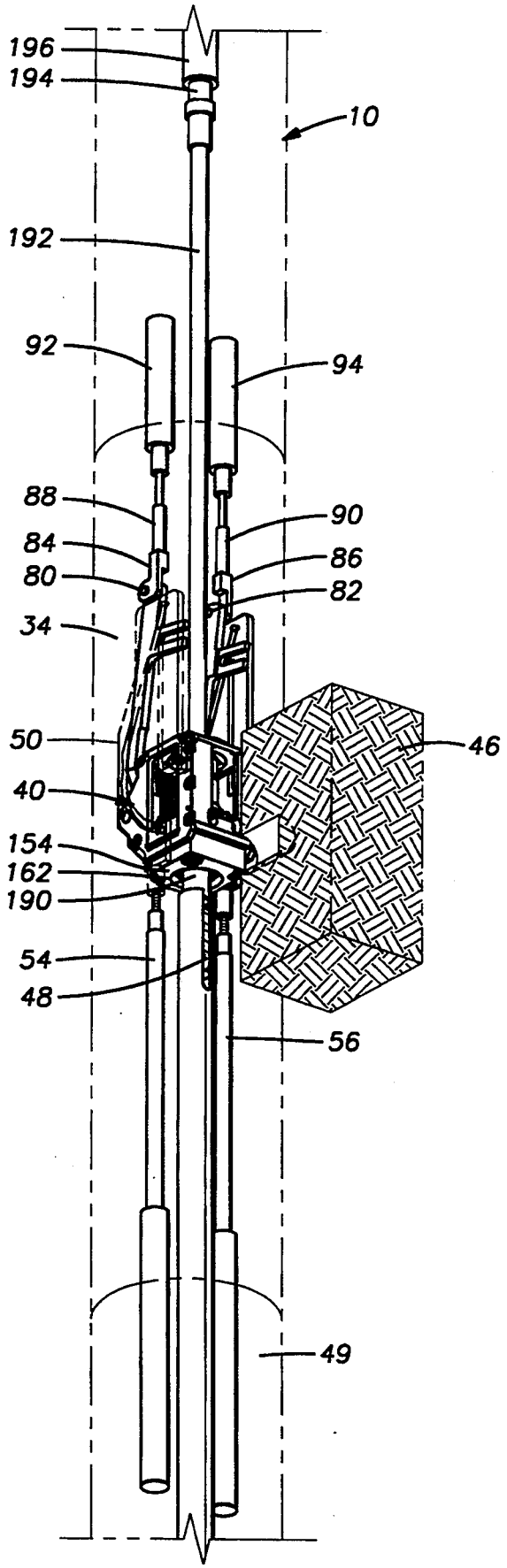

Referring now to FIGS. 3 and 4, within the sidewall coring tool 10 is provided a bit box assembly shown generally at 40, within which the rotary coring bit 24 is mounted for rotation and linear movement between a fully retracted position where the coring bit 24 is fully contained within the bit box housing and a fully extended position as shown in FIG. 3 where the coring bit is extended through an opening 42 in a wall 44 of the bit box and into penetrating relation with the earth formation 46 to acquire a core 48.

It is desirable to achieve substantially rotationally positioning of the bit box assembly 40 for positioning thereof at a coring position as shown in FIG. 3 and for positioning thereof at a core ejecting position as shown in FIG. 4. To accomplish such selective positioning of the bit box assembly and to ensure acquisition of large sidewall cores it has been found desirable to provide the bit box assembly with compound rotary motion to achieve the positioning set forth in FIGS. 3 and 4. This compound rotary motion is evidenced in the partial sectional and partial elevational views of FIGS. 5–7. A pair of spaced actuator plates 50 and 52 are positioned for linear movement within the coring section 34 of the sidewall coring tool and are moveable linearly by respective hydraulic actuators connected thereto by means of respective operator shafts 54 and 56. The operator shafts are adjustable with respect to the actuator plates by means of threaded adjustment elements 58 and 60, thus permitting precision adjustment of the actuator plates relative to the drive shafts 54 and 56 of the hydraulic actuators 62 and (>4. Internally the actuator plates 50 and 52 each define control cam slots 66 and 68, each having curved lower portions and straight and inclined upper portions. The facing internal surfaces of the actuator plates also define L-shaped elongate guide slots 70 and 72. The respective actuator slots 66 and 68 each receive guide pins such as shown at 74 which cooperate with the upper and lower actuators and with the cam slots of the actuator plates to selectively achieve compound rotation of the bit box assembly between its coring and core ejection positions and to achieve linear coring and retracting movement of the coring bit. These features will be discussed in greater detail herein below in connection with FIGS. 5–12.

Figure 5:
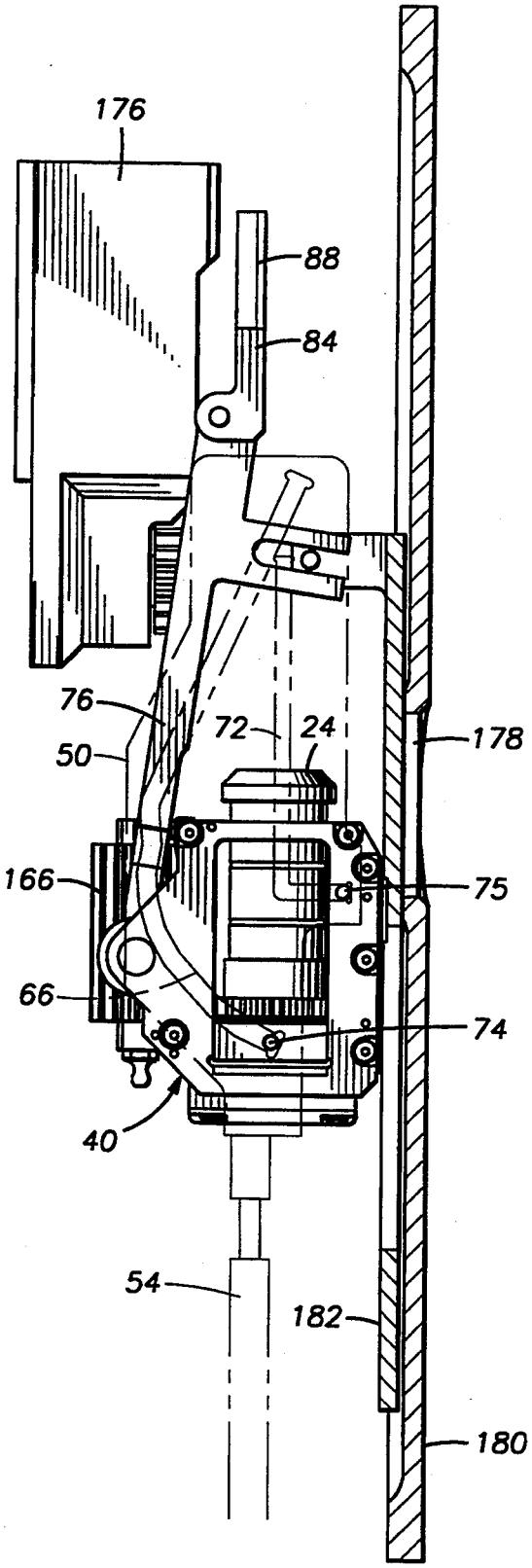
Figure 6:
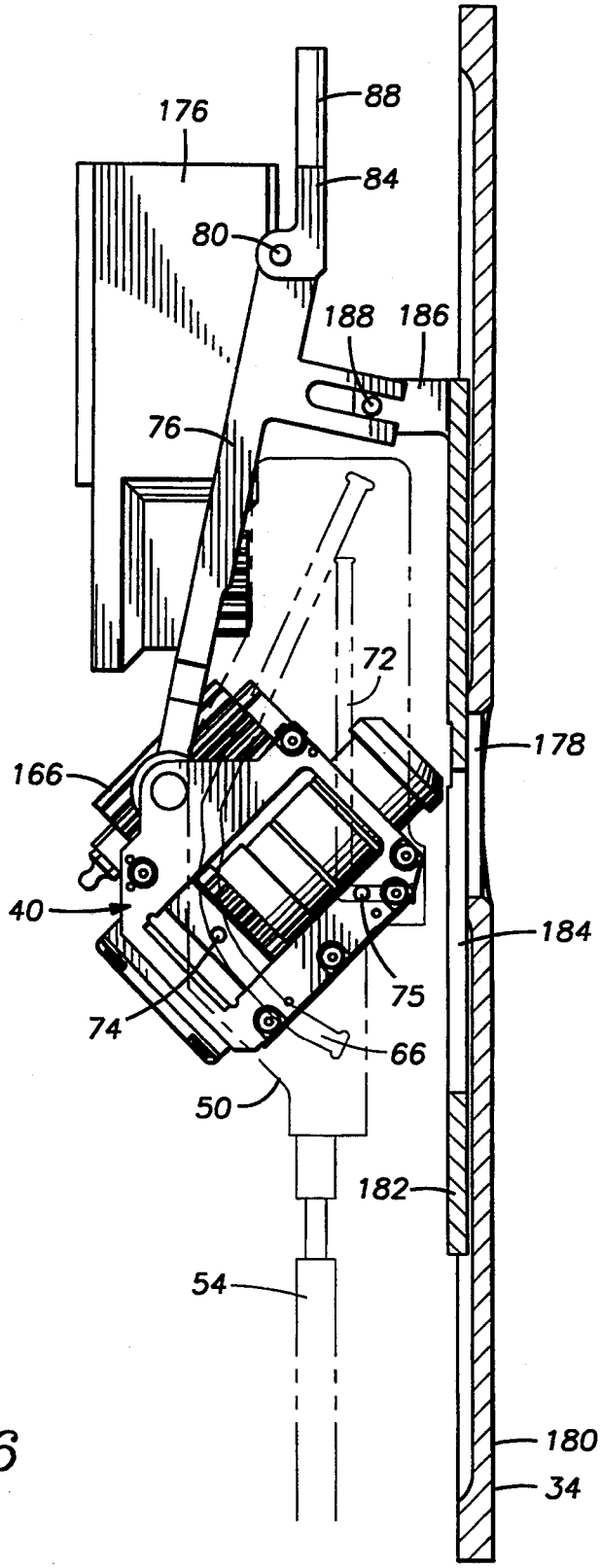
Figure 7:
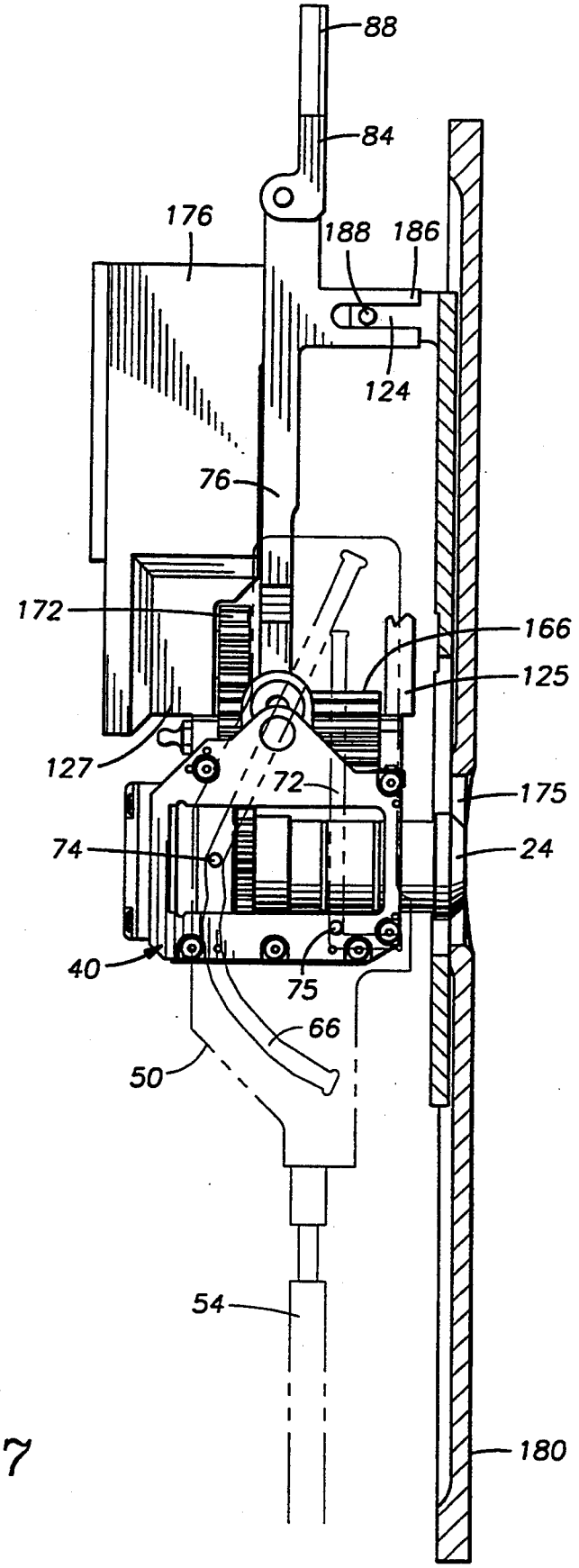
Figure 8:
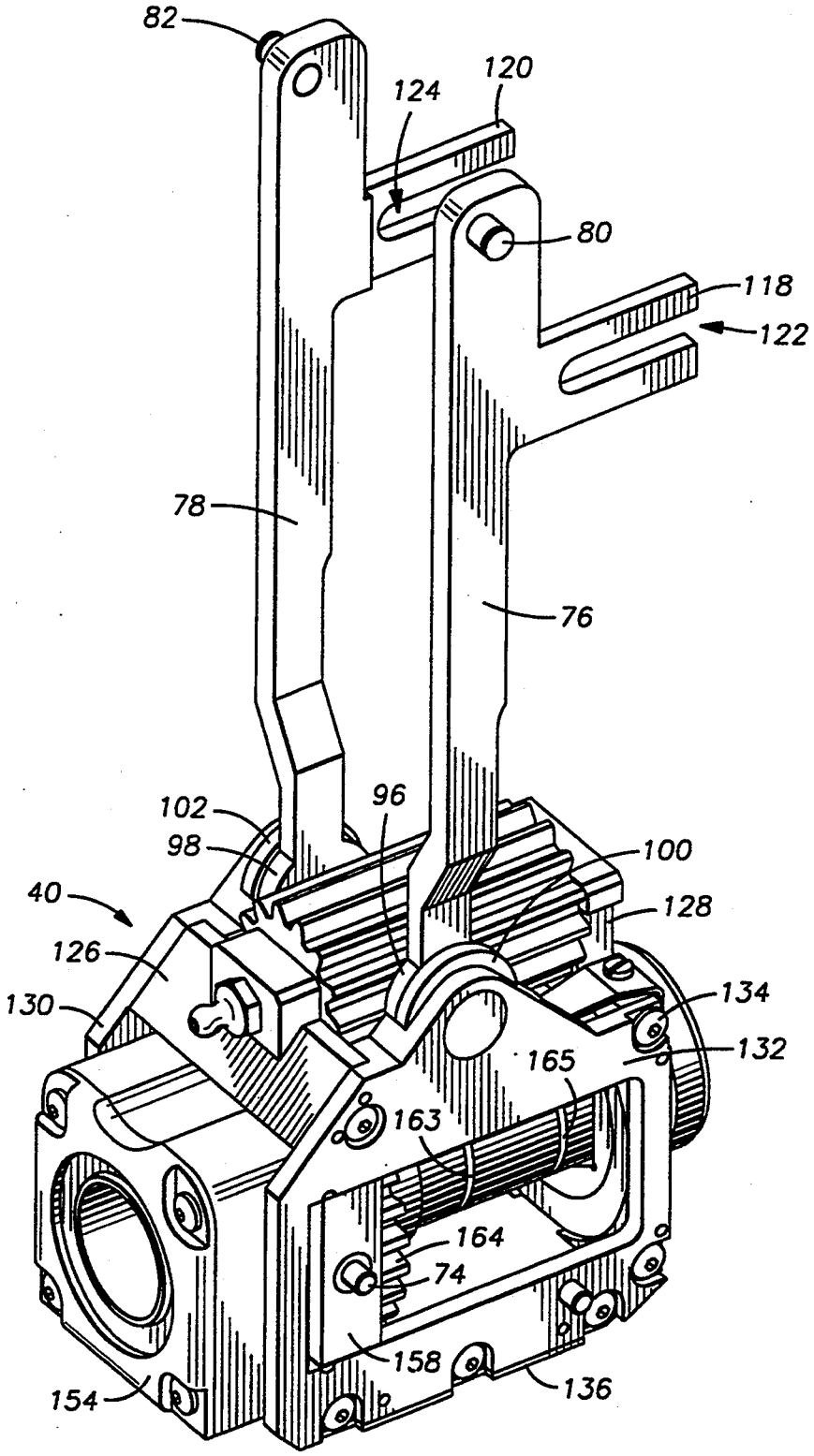
Figure 9:
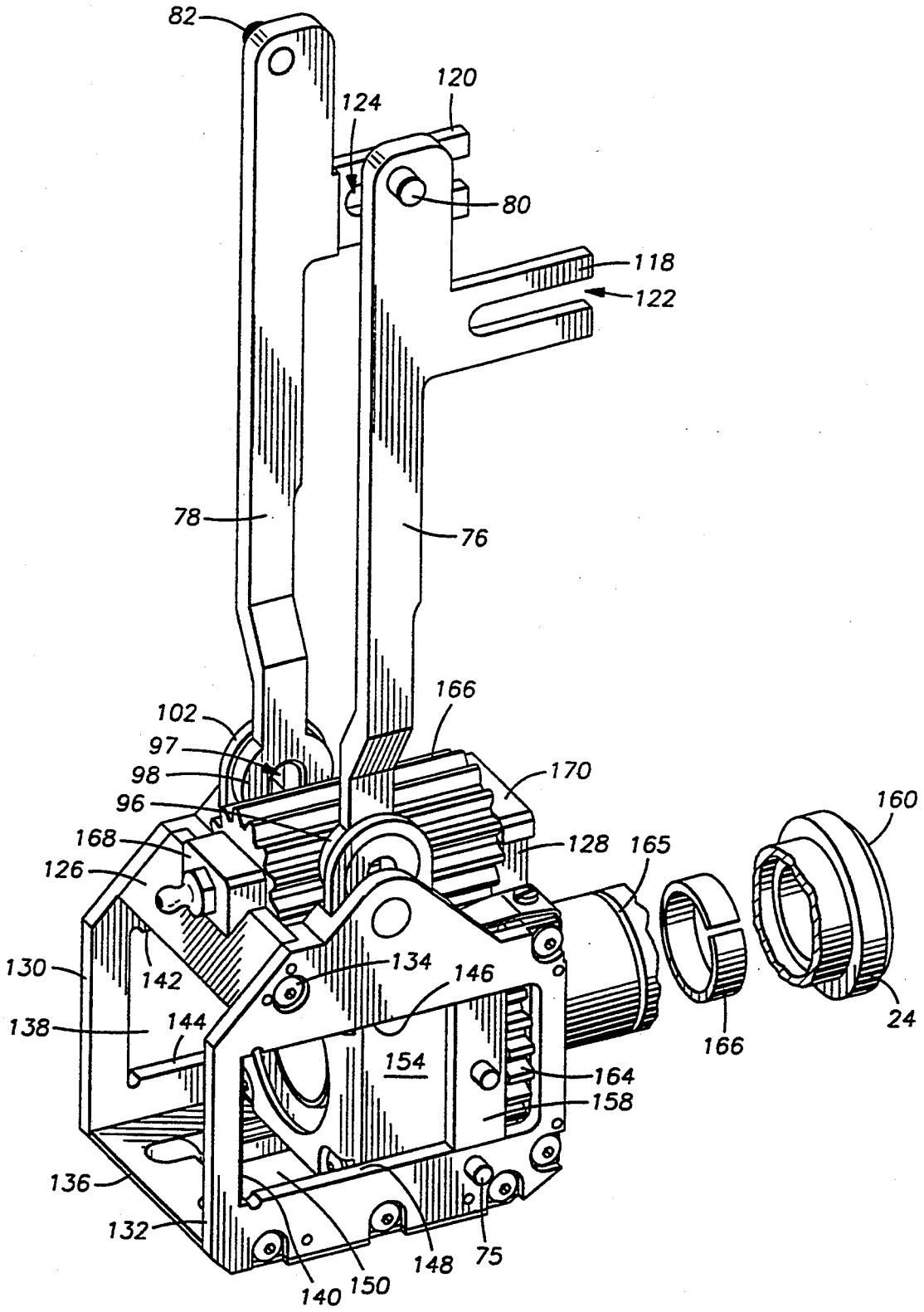

For efficient coring operations it is desirable that the bit box assembly be capable of immobilization within the coring tool during coring and core bit retraction and for core ejection it is desirable that the coring bit be locked at its fully retracted position against linear movement. To accomplish these features, a pair of actuator arms 76 and 78 have lower ends thereof movably connected to the upper portion of the bit box assembly 40 and with the upper portions thereof being secured by means of pivot pins 80 and 82 to pivot brackets 84 and 86. The pivot brackets are provided at the lower ends of respective actuator shafts 88 and 90 that receive forcible actuation from respective hydraulic actuators 92 and 94 with which they are operatively connected. As shown in greater detail in FIGS. 10 and 11, in the exploded view of FIG. 15 and in the partial sectional views of FIGS. 16 and 17 the respective lower ends 96 and 98 of the actuator arms are in assembly with respective movable locking brackets 100 and 102, each being movably received within respective bracket slots 95 and 99 having respective actuator arm openings as shown at 101 having a locking depression 103 at the lower portion thereof as shown in FIG. 15 which is located to receive a pivot pin 105 which receives a retainer screw 106 at the end thereof. The lower, generally circular pivot connector elements 96 and 98 of the actuator arms 76 and 78 each define elongate downwardly opening slots 97 having opposed guide recesses 99 which receive the circular head of the retainer screw 106. For pivoting movement of the actuator arms relative to the bit box the elongate slots 97 will be positioned as shown in FIG. 16 with respect to the pivot pin 105. For non-pivoting relation these components will be positioned as shown in FIG. 17. With reference again to FIG. 15, the lower pivot connector ends 96 and 98 of the actuator arms each define generally circular bosses 107 which are received within the circular openings 101 of the locking brackets 100 and 102. The elongate open bottomed slots 97 permit lost motion movement of the actuator arms and movable brackets within limits defined by the length of the elongate slots 97. When the pivot pins 105 are positioned at the upper ends of the slots 97, and are thus centralized with respect to the circular openings 101 of the locking brackets the actuator arms and bit box establish a pivotal relationship that permits the bit box to undergo its compound rotational movement as shown in FIGS. 5–7. Conversely, when the pivot pins are located within the lower portions of the slots 97, the pivot pins will also be located within the locking depressions 103 of the locking brackets, thus establishing a non-pivotal, locked relationship between the actuator arms and the bit box. T non-pivotal relationship is established to permit coring activity as shown in FIG. 17.

Figure 10:
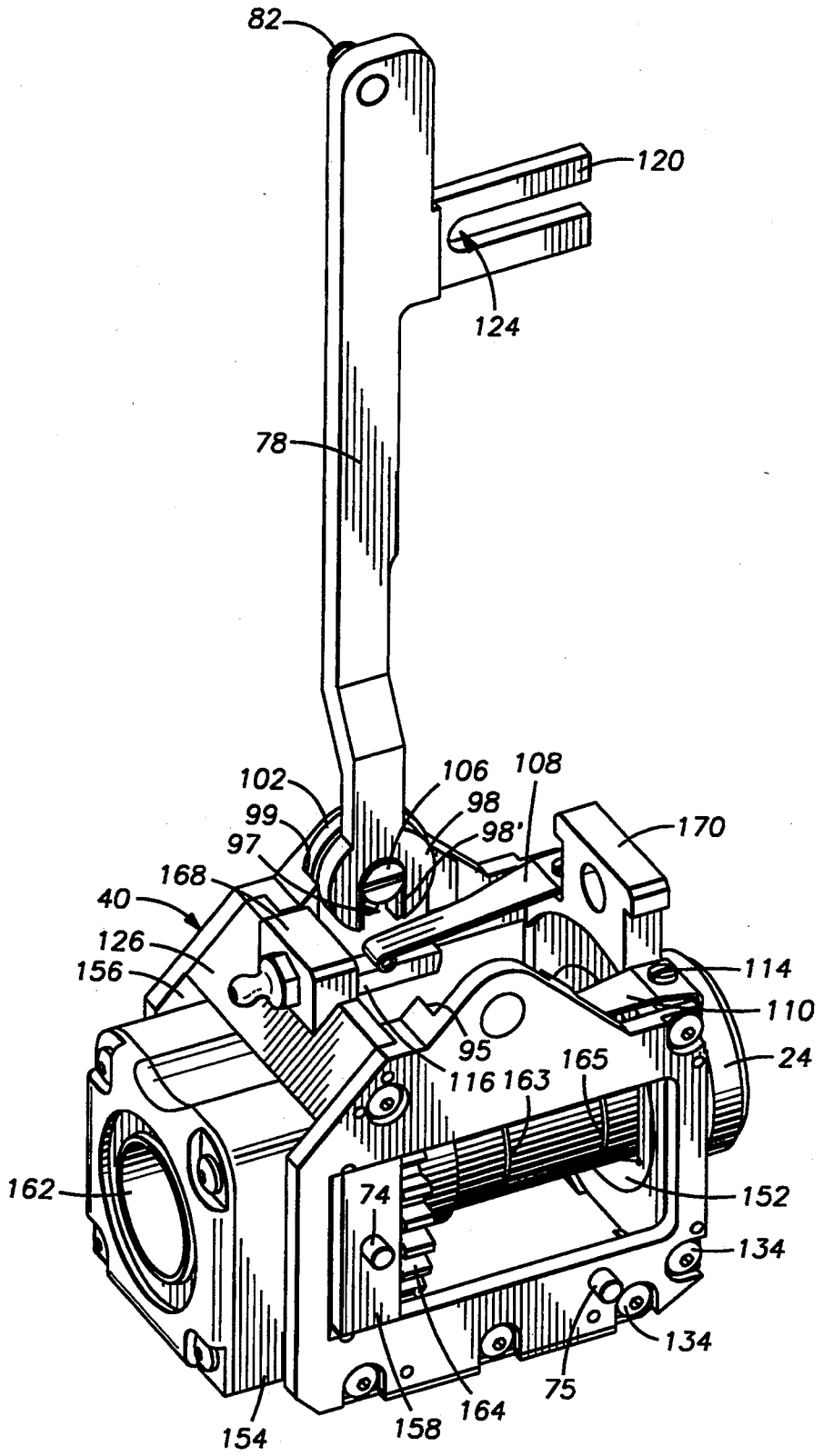
Figure 11:
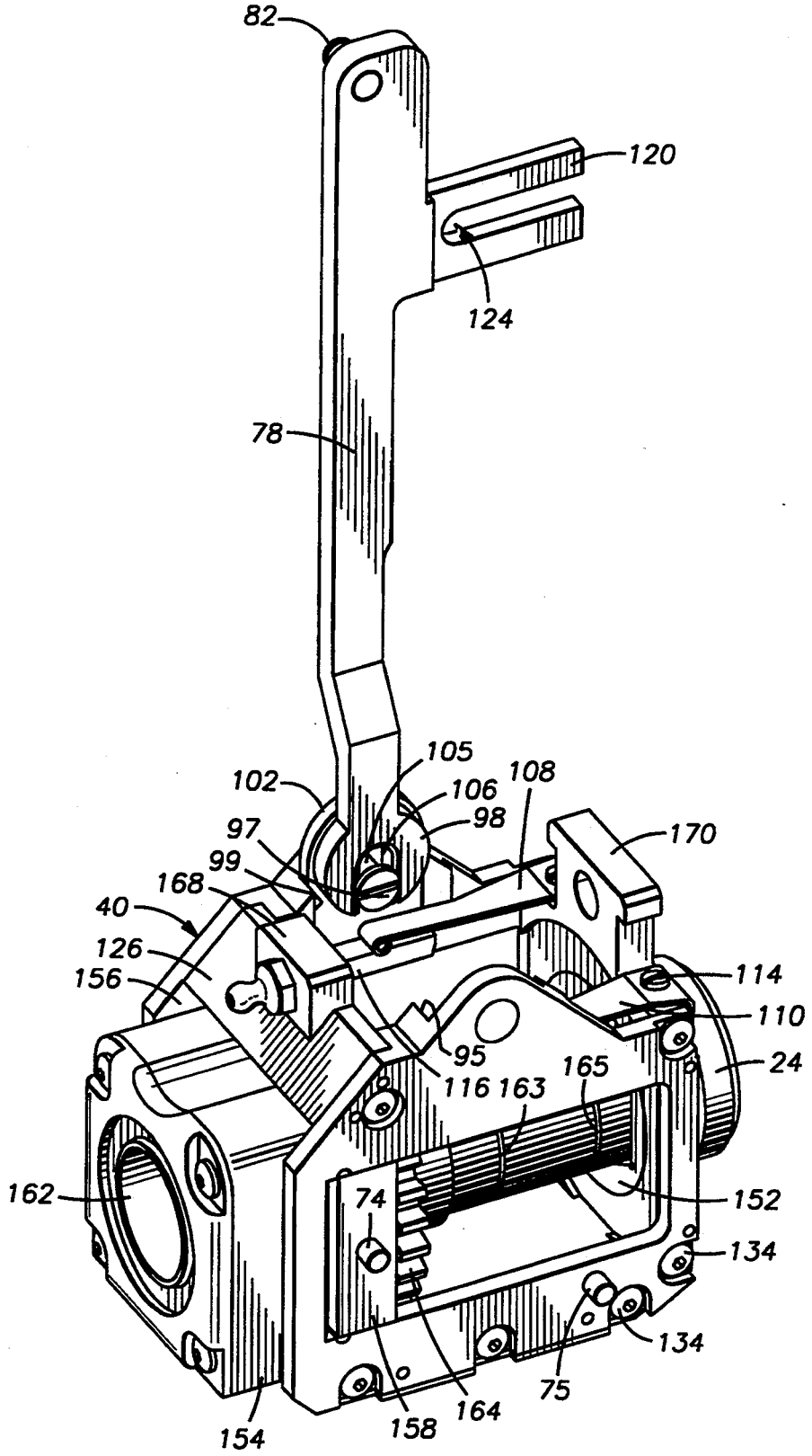

A pair of leaf springs 108 and 110 are secured to the bit box body structure by means of screws 112 and 114, with the free ends of the leaf springs contacting and applying a downward force on the upwardly facing shoulders 116 of the movable bit locking brackets 100 and 102. The leaf springs each apply a downward force on the locking brackets which results in the application of respective upward forces on the bit box. Thus, when the actuator arms begin to be moved downwardly by the actuators, rather than floating freely within the housing, the bit box is urged by the leaf springs to remain stationary with relation of the tool body until arms 78 and 76 reach their tilting position as shown in FIG. 10. This will position the bottom 117 of locking brackets against the driven gear 164 of the core bit 24 so that the bit box 154, the driven gear 164 and the bit 24 are now locked in their retracted positions within the housing that is defined by the bit box structure as shown in FIG. 16 to prevent its inadvertent linear extension during compound rotary movement and during upward movement to the coring position of the bit box. Thus, when the actuator arms are moved upwardly, such as shown in FIGS. 11 and 16 the connectors 96 and 98 will be in pivotal relation with the bit box during an initial segment of upward actuator arm movement and then will become locked against pivotal movement relative to the bit box housing when the bit box reaches its coring position. When the upward force on the actuator arms is relaxed the leaf springs acting against the brackets 100 and 102 will urge the bit box upwardly to the position shown in FIG. 10 to unlock the nonpivotal actuator arm connection with the bit box and permit pivoting of the actuator arms about the pivot pins 105. Thus the actuator arm connection with the bit box assembly accommodates the compound rotational movement that the bit box assembly undergoes in its transition between the coring and core ejection positions. This feature also permits bit box tilting for breaking the core away from the formation.

At their upper portions the actuator arms 76 and 78 each define bifurcated projections 118 and 120 each defining laterally opening slots 122 and 124 for receiving the respective actuator pins of a bit opening closure element to be discussed hereinbelow. When moved upwardly by upper actuators 92 and 94 the actuator arms apply upward force to the bit locking brackets 100 and 102 moving them to their bit unlocking positions with the pivot pins 105 being received within the locking depressions 103 for locking the pivot connections relative to the bit box. Through the bit locking brackets the actuator arms urge the bit box housing upwardly against internal housing stops 125 and 127 as shown in FIG. 7. The housing stops may be adjustable if desired so that the bit box housing can be accurately positioned and securely stabilized for efficient coring.

The bit box assembly illustrated generally at 40 defines a housing structure including a transverse bushing support member 126 and an end wall plate member 128 to which is secured a pair of sidewall members 130 and 132 by means of retainer screws or bolts 134. The bit box housing also includes a bottom wail structure 136. The sidewalls 130 and 132 define rectangular openings 138 and 140 with rectangular opening 138 being defined in part by upper and lower parallel planer guide surfaces 142 and 144 and with opening 140 being defined in part by upper and lower parallel planer guide surfaces 146 and 148 respectively. Likewise, the bottom wall 136 of the bit box housing defines a generally rectangular opening 150. Thus, the bit box housing, defined by the side and end members and the bottom plate is generally in the form of a rectangular framework within which the rotary coring bit 24 is supported for rotatable and linear movement. The end plate 128 is provided with a bearing assembly 152 to provide the rotary coring bit 24 with efficient bearing support relative to the bit box housing structure. A linearly movable bit support block 154 is received within a generally rectangular end opening 156 defined by the bit box housing and is provided with a bearing assembly for rotatable support of the coring bit 24 relative thereto. The bit support block 154 is provided with opposed lateral guide projections 158 having the guide pins 74 projecting laterally therefrom for respective engagement within the cam slots 66 and 68 as mentioned above. The transverse or lateral guide projections 158 provide for guided linear movement of the bit support block and rotary coring bit within the bit box housing to thus provide for linear movement of the rotary coring bit as it is projected into or withdrawn from the sidewall formation of the wellbore during coring and core retrieving operations. The rotary coring bit 24 is provided with a circular formation cutting face 160 at one end for cutting into the formation during coring operations. At its opposite end, the rotary coring bit is provided with a core ejection opening 162 from which cores retrieved from the formation are ejected into a storage magazine provided therefor. The rotary coring bit also defines a pair of spaced weakened sections 163 and 165 which permit fracturing of the bit 24 in the event it should become stuck in the formation and cannot be fully retracted. Fracturing of the bit at either of these weakened circumferential areas is achieved simply by tilting the bit box to achieve application of lateral force on the core that is present within the rotary coring bit.

In most cases, coring bits are provided with core catchers which automatically grip the core when the bit is moved in a direction for extraction of the core from the formation. In t case, linear cycling of the coring bit to clear accumulated debris cannot be done. In accordance with this invention the coring bit defines an internal core retainer groove within which is located a split ring type spring retainer 166 which establishes frictional gripping of the core sample but which permits relative linear movement of the coring bit. The split ring core retainer will slip relative to the core so that the bit can be linearly cycled for clearing of accumulated debris. When the core is broken away from the formation by controlled tilting of the bit box the retainer will secure the core within the bit and ensure its extraction from the formation and will readily release the core when it is ejected from the coring bit by the core ejector.

For high torque, low speed rotation of the coring bit 24 a driven pinion gear 164 of large diameter is fixed in non-rotatable relation with the rotary coring bit. The driven pinion gear 164 establishes driven geared relation with an elongate idler pinion gear 166 which is journaled for free rotation by bushing supporting pivotal block sections 168 and 170 which are provided respectively by the end member 126 and the end wall 128 of the bit box housing. The elongate idler gear is disposed for selective geared engagement with a drive pinion gear 172 which is supported for driving rotation by the output drive shaft 174 of a drive motor 176 that is fixed within the coring tool body structure. The elongate pinion gear 166 permits the driving relationship between it and the driven gear 164 to be maintained as the rotary coring bit and its driven gear are moved linearly for coring and core retraction as the bit support block 154 is moved laterally by reaction of the guide pins 74 with the upper, inclined portions of the cam slots 66 and 68. Preferably, the drive motor 176 is a hydraulically energized rotary motor; however, in the alternative, the rotary drive motor may be energized electrically or by any other suitable means.

To permit the drive motor to have high torque capability and to enable the coring bit to retrieve cores in all types of earth formations the drive motor is separate from the rotary coring bit and is connected in driving relation with the bit only when the bit and its bit box housing are oriented for coring. As shown in FIG. 12 the drive pinion gear is positioned in driving relation with the elongate idler gear 166. This condition is established when the bit box assembly is oriented in coring position, with the rotary coring bit 24 oriented in substantially normal relation with the axis of the well bore. When the bit box assembly is oriented at its core ejecting position as shown in FIG. 4 with axis of rotation of the rotary coring bit in substantially coaxial relation with the axis of the wellbore, the elongate idler gear 166 will have been moved to its disengaged relation with the drive pinion gear 172 thus releasing or declutching the drive relation of the drive motor 176 with the rotary coring bit. The drive pinion gear 172, the idler pinion gear 166 and the driven pinion gear 164 cooperate to define a geared motor output speed reduction transmission which, because of the much greater diameter of the driven pinion gear relative to the idler pinion gear and the drive pinion gear, establishes a high torque, relatively slow rotational relationship between the output shaft of the drive motor and the rotary coring bit. This relationship causes the rotary coring bit to be rotated at slow speed with high torque thereby permitting efficient coring operations while at the same time maintaining efficient cooling of the cutting face 160 of the rotary coring bit so that its service life is quite long as compared to conventional coring bits which are for the most part coupled in directly driven relation with the output shaft of a drive motor. The declutching relationship of the elongate idler pinion gear 166 relative to the drive pinion gear 172 is evident from the operational views shown in FIGS. 5, 6, and 7.

With reference particularly to FIGS. 5–7 the bit box assembly 40 is shown in FIG. 5 in its core ejection position which is also shown in FIG. 4. In FIG. 6 the bit box assembly is shown during its compound motion between the core ejecting position of FIG. 5 and the coring position of FIG. 7. In the coring position, with the bit box housing forced upwardly against the housing stops 125 and 127, the rotary coring bit 24 is shown to be positioned in registry with an opening 178 in the wall structure 180 of the intermediate housing section 34. For coring operations the rotary coring bit 24, while being continuously rotated by the motor through the engaged pinion gears of the transmission, is moved linearly through the housing opening 178 and into the formation against which the housing is tightly positioned by the decentralizing arms 28 and 30.

When coring operations are not being conducted it is desirable to close the coring bit opening 178 of the tool housing to prevent large drill cuttings and other debris from entering the coring tool housing and potentially fouling the rotary coring mechanism. To accomplish t feature a closure element 182 is movably positioned within the housing section 34 and defines an opening 184 which is positioned in registry with the housing opening 178 in the coring position of the core box assembly as shown in FIG. 7. For accomplishing controlled movement of the closure member 182 between its open and closed positions relative to the bit opening 178, as shown in FIG. 7, the closure member is provided at its upper end with a pair of laterally extending drive projections 186 each having drive pins 188 which are received respectively within the laterally opening drive slots 122 and 124 of the actuator arms 76 and 78. Thus, as the actuator arms 76 and 78 are moved upwardly and downwardly for controlled rotary actuation of the bit box assembly between the positions of FIGS. 5, 6, and 7, the closure member 182 is correspondingly moved to block the housing opening 178 as shown in FIG. 5 and to move the closure to a position where its opening 184 is in registry with the housing opening 178 when the bit box assembly has reached its coring position. FIG. 6 illustrates the position of the coring box assembly and the closure 182 at a transitional position intermediate, the core ejection position of FIG. 5 and the coring position of FIG. 7. Thus, when coring operations are not being conducted, the housing opening 178 is closed and entry of relatively large foreign matter such as drill cuttings into the coring tool housing is minimized to the point that it does not constitute a problem from the standpoint of coring tool operations.

One of the important features of the present invention is declutching of the pinion gear transmission between the drive motor and the rotary coring bit. This feature is also evident from the operational views of FIGS. 5, 6, and 7. As shown in FIG. 7 with the bit box assembly at its coring position, the drive pinion gear 172 is in geared driving engagement with the idler pinion gear 166. As the bit box assembly begins its compound rotation or translation from the coring position of FIG. 7 the idler pinion gear 166 is moved out of driven relation with the drive pinion gear 172 as shown in FIG. 6 while maintaining its driving relation with the driven pinion gear 164. In FIG. 5 the idler pinion gear is shown to have been positioned with its axis of rotation disposed in substantially 90° offset position relative to its position as shown in FIG. 7. Provision of t transmission declutching arrangement permits a large high torque drive motor, which is stationary within the coring tool housing, to be utilized for coring operations. Normally, the limited housing space that is available for sidewall coring operations requires a direct bit driving motor to be of fairly small dimension and requires that it be coupled in a direct driving relation with the rotary coring bit. This direct driving relationship typically requires the rotary coring bit to be driven at high speed so that in many cases it develops extensive heat during coring operations, thus rapidly wearing the coring bit and significantly detracting from its service life. In accordance with the present invention, the high torque low speed geared transmission arrangement allows the rotary coring bit 24 to be rotated at slow speed with high torque so that heat build up during coring is held at a minimum and its service life is significantly longer as compared to that of conventional sidewall coring mechanisms. This high torque feature also allows the bit to penetrate difficult formations without stalling often.

With the coring box assembly 40 positioned at its core ejection position as shown in FIGS. 4 and 5, it is desirable to eject a core that has been taken from the sidewall formation of the wellbore and to eject into downwardly into the core storage receptacle 55. For core ejection as shown in FIG. 4 a core ejection plunger 190 is movably supported within the housing structure of the sidewall coring tool by means of an operator shaft 192 which is driven linearly by the piston 194 of a core ejection hydraulic actuator 196. The core ejection plunger can be operated only when the bit box is positioned at its core ejection position.

It is desirable to ensure optimum drilling capability of the rotary coring bit 24. However, in the event the coring bit encounters a drilling condition in the formation where the torque provided to its hydraulic drive motor become lower than is desired, the bit may reach a point where it is about to stall in the formation. When this condition occurs, it is desirable to minimize the drilling force on the drill bit, thereby permitting its substantially free rotation and thus, preventing stalling from occurring. As shown in the schematic illustration of FIG. 13, a rotary hydraulic drilling motor 200 having its output shaft driving the drive gear 172 of the reduction gear transmission gear described above, receives hydraulic actuating pressure via a hydraulic circuit 202 from a hydraulic pump 204 driven by an electric motor 206. The hydraulic pump receives its supply from a hydraulic supply 208 and has its discharge line 2 10 coupled in driving relation with the bit drive motor 200 across a two-way solenoid valve 212. The discharge pressure of the pump is in communication with a pilot line 214, the pressure of which is controlled by a pressure relief valve 216. The pilot line is coupled to the pilot side 218 of an adjustable sequence valve 220 having a closed state as shown at 222 in FIG. 13 and an open state as shown in 224 in FIG. 14.

NORMAL CORING MODE

When hydraulic fluid flow under pressure is supplied to hydraulic motor 200 in the CW condition the hydraulic fluid output from the two way valve 212 is also applied to the pilot side 218 of sequence valve 220. If the hydraulic pressure provided is lower than a preset adjustment of the sequence valve pilot 218 the sequence valve will remain closed and there will be no communication between the input side 219 and the output side 221 of the sequence valve. Thus, the hydraulic line 223 connected from input 219 to point "B", which is the piston side of hydraulic cylinder 62 will not have a flow of fluid therein.

As mentioned above, the rotary coring bit 24 is moved linearly during extension and retracting movement by linear actuation of the actuator plates 50 and 52. For purposes of simplicity, only actuator plate 50 is shown in FIGS. 13 and 14. The linear force applied to the actuator plate 50 through the shaft 54 by hydraulic pressure in the hydraulic actuator 62, which acts upon the actuator piston 63, acting through the guide pin 74, controls the force of the rotary coring bit 24 against the formation being cored. For selective actuation of the hydraulic cylinder 62, a line 226 is coupled with the piston shaft side of the hydraulic actuator while line 228 is coupled with the piston side of the actuator. Hydraulic pressure to the cylinder 62 is controlled by a hydraulic supply pump 230 being driven by an electric motor 232 and having its discharge conducted across a four-way solenoid valve 224 for supplying and permitting discharge of pressure from the respective chambers of the cylinder actuator 62. The solenoid control valve is coupled across pressure relief valves 236 and 238 which permit flow within the cylinder supply and return lines 226 and 228.

BY-PASS MODE

If the coring bit 24 encounters a coring condition where the torque provided to hydraulic motor 200 by the hydraulic pump 204 is near its maximum, then the bit will be near the point where it is about to stall. At t time, the oil pressure at point "C⇄ increases. When the oil pressure reaches the preset value of pilot 218 it will cause the input 219 to connect to the output 221 of the sequence valve as shown in FIG. 14. This will cause oil from the pilot check valve 238 to flow through the bypass line 223 and through the sequence valve 220 to the receiving tank 209, thereby decreasing pressure that is ordinarily applied, in the coring mode, through actuator line 226 to the shaft side of the actuator piston 63. This action has the effect of canceling the force on the bit 24 allowing it to be turned freely by the motor 200, without the load that is normally applied to it by the piston actuator 62. At this time, pressure at point "C" decreases since the load on the bit has decreased, thus causing the pilot 218 of sequence valve 220 to interrupt the oil flow from point "B" to the bypass tank 209. Since this activity removes the stalling force the hydraulic pressure to pilot 218 will decrease below the preset pilot pressure and the sequence valve will be returned to the normal, coring mode of FIG. 13.

AUTOMATIC CORING

While drilling (coring) if the force applied to the bit by the bit drive motor 200 is too high, the bit will cease to turn and the oil will bypass the linear hydraulic actuator motor 62 as described above regarding the bypass mode. But if the force applied to the bit is too small, the bit will not penetrate the formation. This means that the force applied to the bit (bit load) must be constantly adjusted for the optimum drilling condition. This is almost impossible to execute manually from the surface. An automatic system has been incorporated into the sidewall coring tool of this invention to accomplish this result without necessitating manual attention.

Under normal coring conditions the control system will be in the normal coring mode of FIG. 13, with pump pressure driving the rotary motor and driving the actuator plates downwardly to advance the bit into the formation. When the bit force becomes excessive the system will automatically switch to the bypass mode of FIG. 14, thus deenergizing the actuator 62 and relieving the bit force.

Under conditions where the rotary bit drive motor 200 is about to stall, the pilot pressure in line 214 will begin to increase as the pilot pressure sensed by pilot 218 reaches the preset pilot pressure of thee adjustable pilot, the normally closed sequence valve 200 will change from its closed state 222 to its open state 224. In its open state, fluid pressure in the by-pass line 223 will be conducted through the sequence valve to the hydraulic reservoir, thus relieving the pressure on supply line 226 so that the piston 63 ceases its downward hydraulic actuation and thus, the rotary coring bit 24 ceases its linear extension force against the formation. Under t condition, the rotary coring bit 24 can be freely rotated by the bit drive motor 200. T freely rotating condition of the coring bit causes the pilot pressure in line 224 to diminish below the pre-set pressure level of the pilot 218. This causes the sequence valve 220 to return to its closed state as shown in 222, thus ceasing flow in the by-pass line 223 and again permitting the pump pressure to act through line 226 on the stem side of the piston 63, thus driving it downwardly as shown in FIG. 13 and causing extension actuation of the rotary bit 24 by downward actuation of the actuator plate 50 so that its angulated slot reacts against the guide pin 74 for developing and advancing force on the rotary coring bit.

Thus, it can be seen that the rotary coring bit is provided with an automatic, pressure responsive capability which removes the advancing force in the event it is about to stall and restores the advancing force when the stalling position has depleted. The coring bit, therefore, is driven against the formation in a manner that achieves optimum bit penetration and yet, prevents stalling of the bit if stalling conditions are present. This automatic drilling hydraulic circuitry enables optimum drilling of the rotary coring bit without requiring any significant degree of attention by service personnel.

All of the various functions of the sidewall coring mechanism are capable of being controlled and monitored individually from the surface. Since the functions can be individually controlled operating personnel can alter the sequence of sidewall coring events, according to the various conditions of the bore hole, the formation being cored, and conditions of the coring bit itself. For example, to prevent any undesired build-up of debris behind the coring bit as it penetrates will into the formation, it may be desirable to cycle the coring bit back and forth between its coring and partially retracted positions. As the core bit is retracted, while being rotated, or while non-rotated, any debris build-up behind the coring face of the bit is displaced into the well bore so that it does not interfere with operation of the bit. In some circumstances, t debris could become sufficiently extensive that the coring bit may not be withdrawn from the bore hole. This disadvantage is effectively overcome by providing operating personnel with the capability of individually controlling cyclic extension and retracting of the core bit for periodic displacement of coring debris which could interfere with coring or core retraction as coring operations are conducted. As the coring bit is linearly cycled in this manner the split ring retainer simply slides along the length of the core without interfering with bit movement.

The present invention effectively provides operating personnel with the capability of monitoring and individually controlling many different coring functions from the surface. Operating personnel are provided with a visual readout at monitor 23, while coring, of the voltage at the surface, voltage at the tool head and the electrical current being supplied to the coring tool. There is also provided a monitor readout of the pressure of hydraulic fluid at the tool head as an indication of the torque being experienced by the bit drive motor for coring bit rotation and the pressure of hydraulic fluid for auxiliary hydraulic functions such as hydraulic actuator operation for bit box positioning. The monitor 23 provides a display capability for bit load as coring progresses, rate of bit penetration, depth of coring bit penetration, elapsed time of coring activity and estimated time for each coring procedure. The positions of various components of the sidewall coring tool are also visually presented by the monitor to enable operating personnel to very closely monitor tool operation and determine that selected functions are being carried out. For example, the monitor 23 will visually display the bit box position and bit location relative to the bit box as well as angle of bit box tilting for core breakage. The position of the core ejecting rod is also visually displayed.

OPERATION

The sidewall coring tool of the present invention is run into the well bore by means of conventional wireline equipment as indicated above and is both run and retrieved relative to the wellbore with the bit box assembly positioned in its core ejecting position as shown in FIG. 5 and with the closure 182 at its closed position. Upon being positioned at a selected location within the well bore the decentralizing arms 28 and 30 are energized thus forcing the sidewall coring tool laterally such that its coring side is disposed in tight engagement with the wellbore wall and with the core bit opening 178 in juxtaposition relation with the formation to be cored. At this point the bit box assembly is moved for the core ejection position of FIG. 5 by compound rotational movement and is positioned for coring as shown in FIG. 7. This is accomplished by first rotating the bit box assembly to its coring position and then immobilizing the bit box housing within the tool. The rotational activity is accomplished by upwardly energizing the actuator arms 76 and 78 by means of the hydraulic cylinders 92 and 94 thus providing an upward force on the bit box assembly through the lost motion connection defined between actuator arm connectors 96 and 98 and the movable bit locking brackets 100 and 102 and the respective movable relationships thereof relative to the actuator slots 104 and the actuator pivot pins or screws 106. At the bit box position of FIG. 5 the pivot pin 105 will be centered within the circular opening 101 of the locking brackets so that the bit box is unlocked and freely pivotal relative to the actuator arms 76 and 78. As upward force is applied to the bit box housing through the connectors 96–98, the pivot pins 105 and the bit unlocking brackets 100–102, the guide pins 75 will function essentially as pivots while guide pins 74 will traverse the lower curved portions of the guide slots 66 and 68. Thus the bit box assembly will undergo compound rotational movement as evidenced by FIG. 6 which is determined cooperatively by the L-shaped guide slots 72 and the lower curved portions of the guide slots 66 and 68.

After reaching the position of FIG. 7 the bit box housing must be immobilized within the tool housing so that no coring box movement occurs as the coring bit is rotated and extended into the formation. Also, the rotary coring bit must be unlocked so that it can be extended linearly during its rotation. Bit box immobilization occurs as further upward force of the actuators 92 and 94 urge the locking brackets and bit box housing upwardly so that the housing seats on and becomes stabilized by the internal downwardly facing stops 125 and 127. When t occurs that bit box housing becomes essentially fixed within the coring tool housing. After the bit box housing has engaged the tops 125 and 127 the locking brackets are moved upwardly to the extent permitted by the length of the actuator arm connector slots 97 as shown in FIG. 17 thus moving the lower portion of the locking brackets upwardly to positions clearing he driven gear 164 and thus releasing the coring-bit 24 for linear movement. Upward movement of the locking brackets relative to the seated bit box preloads the leaf springs 108 and 110 so that, when the upward force on the locking brackets and bit box is subsequently relieved, the springs will again position the bit box housing at its bit locking position relative to the locking brackets.

In FIGS. 5–7 the relative positions of the guide pins 74 and the lower curved portions of the guide slots 66 and 68 are clearly evident. The various positions of the guide pins 74 relative to the guide slots is depicted by solid line and broken line positions, the solid lines of the guide pins indicating the respective actual positions of the guide pins relative to the guide slots at the bit box housing position shown in FIGS. 5, 6, and 7. During this upward movement of the actuator arms 76 and 78 the actuator arms will pivot about the pivot pins 80 and 82 and will also pivot about the pivot pins 105. This pivoting arrangement is necessary to permit the compound rotational movement that is induced by the bit box housing structure during correlation of the guide slots at various rotational positions.

As mentioned above, during compound rotation of the bit box assembly from the FIG. 5 position of the FIG. 7 position the elongate idler gear 166 is separated from the drive pinion gears 172, thereby declutching the drive transmission between the drive motor 176 and the driven gear 164 of the rotary coring bit. The transmission between the drive motor and coring bit is engaged only when the bit box is seated against the housing stops 125 and 127.

During compound rotation of the bit box assembly as shown in FIGS. 5–7 the actuator plates 50 and 52 will be maintained substantially fixed within the coring tool housing, being supported by the actuator shafts 54 and 56 of the hydraulic actuators 62 and 64. After compound rotation of the bit box assembly has achieved immobilized coring positioning of the bit box assembly as shown in FIG. 7 the lower hydraulic actuators 62 and 64 will be energized thereby inducing downward movement of the actuator plates 50 and 52 while the bit box hosing remains immobilized by its seating against the stops 125 and 127 as indicated above. T downward actuator plate movement causes the guide pins 74 to traverse the straight, inclined upper section of the guide slots and thus accomplishes linear driving of the bit block assembly 154 through the guide pins 74 of lateral projections 158. This causes the guide projections 158 to move linearly within the bit box housing being guided by the upper and lower guide surfaces of the rectangular side plate openings and thus causes the rotary coring bit 24 to be moved linearly into the formation while it is rotated by the drive motor through the geared transmission. The drive motor 176 is energized during lateral driving of the rotary coring bit so that the cutting face of the coring bit cuts into the formation and achieves a core within the coring bit passage 161. During linear coring movement of the coring bit 24 the driven pinion gear 164 traverses the length of the elongate idler gear 166 while maintaining geared driving relation therewith. The actuator plates 50 and 52 will be driven downwardly by the lower hydraulic actuators until the guide pins 74 will have reached the uppermost portions of the guide slots 66 and 68. At this position, the rotary coring bit 24 will have been fully extended and will have completed its coring operation.

After coring has been completed it is necessary to separate the core sample from the formation. This is best done by applying lateral force to the core while the core bit is fully extended, thus breaking the core sample from the formation at a point near the cutting face 160 of the bit. When the core breaks in this manner the split ting retainer will secure the core sample in immovable relation within the bit passage 161 so that the core sample cannot remain in the formation during bit retraction and cannot interfere with bit box movement during rotation of the bit box toward its core ejecting position.

After a core sample has been acquired in t manner the lower hydraulic actuators 62 and 64 will be energized to drive the actuator plates 50 and 52 upwardly, thereby causing the guide pins 74 to again traverse the upper inclined portions of the actuator slots 66 and 68, thereby shifting the bearing block 154, its guide projections 158 and the rotary coring bit to its fully retracted position as shown in FIG. 7. Thereafter, with the lower actuators 62 and 64 deenergized, and securing the actuator plates in their immovable bit box rotating positions, the upper actuators will again be energized so as to apply a downward force on the actuator arms 76 and 78 with the coring bit fully retracted as shown in FIG. 16, causes unlocking movement of the locking brackets 100 and 102 form the FIG. 17 positions thereof toward the FIG. 16 positions. As the brackets move downwardly the leaf springs, applying the preload spring force between the brackets and bit box housing, will shift the bit box and brackets so as to center the pivot pin 105 within the circular bracket openings 101, thus unlocking the actuator arms from the bit box so that the connection therebetween will become pivotal. Thus, downward movement of the actuator arms and locking brackets unseats the bit box housing from the immobilization stops 125 and 127 and shifts the bit locking brackets downwardly to engage behind the driven gear 164 and lock the coring bit 24 at its retracted position in readiness for pivoting. Further downward force on the bit box housing then causes the guide pins 74 to traverse the lower arcuate portions of the guide slots 66 and 68 thereby inducing compound rotation to the bit box assembly through the position shown in FIG. 6 to the core ejecting position shown in FIG. 5.

After the position of FIG. 5 has been reached the core 48 is ejected from the passage 161 of the rotary coring bit through the core ejection opening 162 by the core ejection plunger 190 under the influence of downward force applied by the hydraulic actuator 196 through the plunger drive shaft 192. The split ring core retainer will allow the core to slip through it as its frictional retaining force on the core sample is overcome by the force of the core ejection plunger. After reaching this position a coring operating cycle will have been completed, and a core will have been received by the core storage receptacle 55. The core storage receptacle may be of any character appropriate for positioning multiple cores in serially oriented manner so that upon retrieval from the wellbore each of the cores may be correctly associated with the formation depth from which it was taken. As shown in the drawings the core receptacle may comprise an elongate tube 55 of sufficient length to retain a desired number of core samples.

As mentioned above, the rotary coring bit 24 is moved linearly during extension and retracting movement by linear actuation of the actuator plates 50 and 52. For purposes of simplicity, only actuator plate 50 is shown in FIGS. 15 and 14. The linear force applied to the actuator plate 50 through the shaft 54 by hydraulic pressure in the hydraulic actuator 62, which acts upon the actuator piston 63, acting through the guide pin 74 controls the force of the rotary coring bit 24 against the formation being cored. For selective actuation of the hydraulic cylinder 62, a line 226 is coupled with the piston shaft side of the hydraulic actuator while line 228 is coupled with the piston side of the actuator. Hydraulic pressure to the cylinder 62 is controlled by a hydraulic supply pump 230 being driven by an electric motor 232 and having its discharge conducted across a four-way solenoid valve for supplying and preventing discharge from the respective chambers of the cylinder actuator 62. The solenoid control valve is coupled across pressure relief valves 236 and 238 which permit flow within the cylinder supply and return lines 226 and 228.

Many modifications and variations besides those specifically mentioned may be made without substantially departing from the concept of the present invention. Accordingly, it should be clearly understood that the forms of the invention described and illustrated herein are exemplary only and are not intended as limitations on the scope of the present invention.

We claim:

1. An apparatus for acquiring at least one sidewall core from a wellbore, said apparatus comprising;

(a) a coring tool body having a core receptacle therein and being adapted for positioning at selected formation depths within said wellbore;

(b) a rotary drive motor being located within said coring tool body;

(c) a rotary coring bit movably located within said coring tool body, said bit orientable within said coring tool body from a coring position being substantially normal to the axis of said tool body to a core ejecting position in registry with said core receptacle, said rotary coring bit being extendable into said formation while being rotated by said rotary drive motor for acquisition of a core and being retractable from said formation and into said coring tool body for recovery of said core;

(d) means for selectively orienting said rotary coring bit at said coring position and said core ejecting position;

(e) a core ejector operative at said core ejecting position of said rotary coring bit for moving the core from rotary coring bit and into said core receptacle; and (f) a speed reduction transmission within said coring tool body engaging said rotary drive motor in rotary driving relation with said rotary coring bit at said coring position, said speed reduction transmission providing a rotary output to said coring bit which has substantially lower speed and higher torque than provided by said motor.

2. An apparatus for acquiring a plurality of sidewall core samples from selected depths within a wellbore, said apparatus comprising;

(a) a coring tool body having a core receptacle therein and being adapted for positioning at selected positions within said wellbore, said coring tool body defining a longitudinal axis;

(b) a rotary drive motor being located within said coring tool body;

(c) a motor driven rotary coring bit having an axis of rotation being movably located within said coring tool body and being orientable within said coring tool body from a coring position being substantially normal to the axis of said tool body to a core ejecting position in registry with said core receptacle, said motor driven rotary coring bit being extendable into said formation while being rotated by said rotary drive motor for acquisition of a core sample and being retractable from said formation and into said coring tool body for recovery of said core;

(d) means for selectively orienting said rotary coring bit at said coring position and said core ejecting position;

(e) a core ejector, operative at said core ejecting position of said rotary coring bit for moving into said rotary coring bit and displacing said core sample into said core receptacle;

(f) a speed reduction transmission within said coring tool body engaging said rotary drive motor in rotary relation with said rotary coring bit at said coring position, said speed reduction transmission providing a rotary output to said coring bit which has substantially lower speed and higher torque than provided by said motor;

(g) actuator means being moveable within said coring body and having interactive connection with said rotary coring bit for inducing linear extension of said rotary coring bit during rotation of said bit for cutting of a core sample and being oppositely moveable for inducing linear retraction of said rotary coring bit and the core sample contained therein into said coring body, said actuator means comprising a pair of actuator plates being disposed in spaced relation within said coring tool body, each of said actuator plates having a guide slot and an orienting slot therein, a bit box providing rotary and linearly movable support for said rotary coring bit and being mounted for rotation and linear movement relative thereto, said bit box having orientation pins projecting therefrom and being disposed in orienting interengagement with said orienting slot and said guide slot, upon linear movement of said actuator plate said cam slot and guide slot reacting with said orientation pins and selectively orienting said bit box within said coring tool body thus selectively positioning said rotary coring bit at said coring position and said core ejecting position, plate actuator means being disposed for linear movement within said coring tool body and being selectively operative for imparting directionally controlled linear movement to said actuator plates for selective linear movement of said rotary coring bit at said coring position, actuator arm means having driving interconnection with said bit box and being movable for movement of said bit box within said coring tool body, and an actuator arm operator being movable linearly within said coring tool body and having pivotal interconnection with said actuator arm means, said driving interconnection being pivotal during movement of said bit box between said coring and core ejecting positions thereof and being locked upon positioning of said bit box at said coring position.

3. An apparatus for acquiring a plurality of sidewall core samples from selected depths within a wellbore, said apparatus comprising;

(a) a coring tool body having a core receptacle therein and being adapted for positioning at selected positions within said wellbore, said coring tool body defining a longitudinal axis;

(b) a rotary coring bit having an axis of rotation being movably located within said coring tool body and being orientable within said coring tool body from a coring position being substantially normal to the axis of said tool body to a core ejecting position in registry with said core receptacle, said rotary coring bit being extendable into said formation for acquisition of a core sample and being retractable from said formation and into said coring tool body for recovery of said core;

(c) means for selectively orienting said rotary coring bit at said coring position and said core ejecting position;

(d) a core ejector, operative at said core ejecting position of said rotary coring bit for moving into said rotary coring bit and displacing said core sample into said core receptacle;

(e) a speed reduction transmission within said coring tool body engaging said rotary drive motor in rotary relation with said rotary coring bit at said coring position, said speed reduction transmission providing a rotary output to said coring bit which has substantially lower speed and higher torque than provided by said motor;

(f) a source of hydraulic pressure;

(g) a hydraulically energized rotary motor adapted for selective driving relation with said rotary coring bit;

(h) a linear hydraulic motor being connected in advancing and retracting relation with said rotary coring bit and being energized for linear actuation by hydraulic pressure from said source of hydraulic pressure; and (i) a pilot actuated sequence valve being connected with said source of hydraulic pressure to said linear hydraulic motor and having a normal mode blocking flow of hydraulic fluid through said sequence valve and a bypass mode bypassing hydraulic pressure of said linear hydraulic actuator for deenergizing said linear hydraulic actuator, said pilot actuated sequence valve shifting from said normal mode to said bypass mode when hydraulic pressure to said rotary hydraulic motor increases to a preset value.

4. The apparatus of claim 3 wherein said means for selectively orienting said rotary coring bit comprises:

(a) a bit box supporting said rotary coring bit for rotatable and linear movement and having guide pins projecting therefrom;

(b) a pair of actuator plates having actuation guide grooves therein receiving said guide pins, said actuator plates being movable linearly for imparting linear extension and retraction to said rotary coring bit and being positionable at a predetermined location for bit box orientation; and (c) actuator arm means having driving connection with said bit box and being selectively movable for causing rotational orientation movement of said bit box between said coring position and said core ejection position.

5. The apparatus of claim 4, wherein:

(a) said actuation guide grooves define curved sections and inclined, substantially straight sections; and (b) said guide pins traversing said curved sections during bit box orientation and traversing said inclined substantially straight sections during linear extension and retraction of said rotary coring bit.

6. The apparatus of claim 4, including:

a pivotal locking connection between said actuator arm means and said bit box and being locked when said bit box is at said coring position and being unlocked for pivotal movement relative to said bit box upon movement of said bit box from said coring position.

7. The apparatus of claim 6 wherein said pivotal locking connection comprises:

a locking bracket being connected to said actuator arm means and being secured for limited movement relative to said bit box and being movable to a locking position for securing said rotary coring bit against linear extension movement and an unlocking position permitting linear extension movement of said rotary coring bit, said locking bracket being movable between said locking and unlocking positions by said actuator arm means.

8. The apparatus of claim 6, further comprising:

(a) a pair of locking brackets defining circular pivot openings therein and further defining locking depressions;

(b) a pair of actuator arms each having a pivot connection boss being pivotally received with a respective circular pivot opening and each defining an elongate locking slot;

(c) pivot pins projecting from said bit box and extending though said pivot openings and locking slots; and (d) said actuator arms being positionable for location of said pivot pins centrally of said circular pivot openings and pivot connection bosses for establishing a pivotal relationship between said actuator arms and said bit box and being positionable for location of said pivot pins within said locking depressions for locking said actuator arms relative to said bit box.

9. The apparatus of claim 7, further comprising:

spring means providing spring force between said locking brackets and said bit box, said spring force maintaining said locking brackets in locked relation with said rotary coring bit in absence of mechanically induced forces overcoming said spring force.

10. The apparatus of claim 4, further including:

(a) a housing;

(b) positioning stop means being defined within said housing; and (c) said bit box being seated against said positioning stop means by said actuator arm means at said coring position of said bit box.

11. A sidewall coring mechanism for acquiring a plurality of core samples form selected locations within a wellbore, comprising:

(a) an elongate coring tool body adapted for movement through a wellbore and defining a core bit opening;

(b) a core receptacle being located within said coring tool body and adapted to receive a plurality of core samples in serially oriented relation therein;

(c) a bit box being located within said coring tool body and being movable between coring and core ejecting positions therein, said bit box having guide elements thereon;

(d) a rotary coring bit being supported for rotation and linear movement within said bit box and being in registry with said core bit opening at said coring position of said bit box;

(e) a first actuating mechanism having orienting groove means receiving said guide elements of said bit box and being selectively movable within said coring tool body for inducing linear movement of said rotary coring bit during rotation thereof, said first actuating mechanism being positionable within said coring tool body at a bit box rotating position;

(f) a second actuating mechanism within said coring tool body having rotating connection with said bit box and being selectively movable when said first actuating mechanism is at said bit box rotating position for rotating said bit box between said coring and core ejecting positions; and (g) means for rotating said rotary coring bit during coring.

12. The sidewall coring mechanism of claim 11 wherein said first actuating mechanism comprises:

(a) a pair of spaced actuator plates each defining orienting grooves and guide grooves receiving respective guide elements of said bit box in relatively movable relation therein; and (b) hydraulically energized linear actuator means having driving connection with said spaced actuator plates and imparting selective movement and positioning of said spaced actuator plates.

13. The sidewall coring mechanism of claim 11 wherein said second actuating mechanism compresses:

(a) hydraulically energized linear actuator means; and (b) actuator arm means having a first pivotal connection with said hydraulically energized linear actuator means and having a second pivotal connection with said bit box, said second pivotal connection becoming locked to prevent relative pivotal movement of said actuator arm means and bit box upon movement of said bit box to said coring position.

14. The sidewall coring mechanism of claim 13 wherein said second pivotal connection comprises:

(a) locking bracket means being connected to said actuator arm means and secured for limited movement relative to said bit box and being movable to a locking position for securing said rotary coring bit against linear extension movement of said rotary coring bit, said locking bracket being movable between said locking and unlocking positions by said actuator arm means;

(b) said actuator arm means being pivotally connected to said locking bracket means and having locking slot means;

(c) pivot pin means being provided on said bit box and extending through said locking brackets means and said locking slot means, said pivot pin means and said locking slot means being relatively positionable at a pivot position permitting pivoting of said actuator arm means and said bit box and a locking position securing said actuator arm means in fixed relation with said bit box.

15. The apparatus of claim 11, further comprising:

(a) a pair of locking brackets defining circular pivot openings therein and further defining locking depressions;

(b) a pair of actuator arms each having a pivot connection boss being pivotally received with a respective circular pivot opening and each defining an elongate locking slot;

(c) pivot pins projecting from said bit box and extending though said pivot openings and locking slots; and (d) said actuator arms being positionable for location of said pivot pins centrally of said circular pivot openings and pivot connection bosses for establishing a pivotal relationship between said actuator arms and said bit box and being positionable for location of said pivot pins within said locking depressions for locking said actuator arms relative to said bit box.

16. An apparatus for rotary drilling at least one core sample from the wall of a wellbore penetrating an earth formation, said apparatus comprising:

an elongated coring tool body adapted to traverse said wellbore;

a motor disposed within said tool body;

a rotary coring bit disposed within said tool body; and a speed reducing transmission rotationally coupled to said motor and said bit, said transmission providing a rotary output to said bit having substantially increased torque and substantially reduced speed than provided by said motor.

17. An apparatus for rotary drilling at least one core sample from the wall of a wellbore penetrating an earth formation, said apparatus comprising:

a coring tool body adapted for traversing said wellbore;

a bit box rotatably mounted within said tool body, said bit box selectively orientable between a core drilling position substantially perpendicular to said tool body and a core ejecting position substantially parallel to said tool body, said bit box having guide pins extending from sides of said bit box perpendicular to rotation of said bit box between said core drilling position and said core ejecting position;

a rotary coring bit rotatably and extensibly mounted within said bit box; and actuator plates disposed within said tool body, said plates having elongated slots engaged with said guide pins to cause rotation of said bit box and extension of said bit upon linear movement of said actuator plates;

an actuator arm pivotally connected to said bit box, said actuator arm extended to lock said bit box in said core drilling position, and retracted to enable rotation of said bit box from said core drilling position to said core ejecting position.

* * * * *